US009851092B2

(12) United States Patent
Yotsumoto et al.

(10) Patent No.: US 9,851,092 B2
(45) Date of Patent: Dec. 26, 2017

(54) ELECTRIC LIGHT BULB TYPE LIGHT SOURCE APPARATUS AND TRANSLUCENT COVER

(71) Applicant: Sony Corporation, Tokyo (JP)

(72) Inventors: Naoki Yotsumoto, Tokyo (JP); Kouji Miyata, Kanagawa (JP); Tatsuhiro Obara, Chiba (JP); Kazunori Kusuki, Kanagawa (JP)

(73) Assignee: Sony Corporation (JP)

( * ) Notice: Subject to any disclaimer, the term of this patent is extended or adjusted under 35 U.S.C. 154(b) by 195 days.

(21) Appl. No.: 14/394,912

(22) PCT Filed: Mar. 14, 2013

(86) PCT No.: PCT/JP2013/001726

§ 371 (c)(1),
(2) Date: Oct. 16, 2014

(87) PCT Pub. No.: WO2013/161164

PCT Pub. Date: Oct. 31, 2013

(65) Prior Publication Data

US 2015/0070895 A1 Mar. 12, 2015

(30) Foreign Application Priority Data

Apr. 27, 2012 (JP) ..... 2012-102465
Apr. 27, 2012 (JP) ..... 2012-102504

(51) Int. Cl.
*H04M 1/22* (2006.01)
*F21V 33/00* (2006.01)
(Continued)

(52) U.S. Cl.
CPC ..... *F21V 33/0056* (2013.01); *F21K 9/232* (2016.08); *F21V 3/00* (2013.01);
(Continued)

(58) Field of Classification Search
CPC ..... F21K 9/1355; F21K 9/52; F21V 19/055; F21V 23/0442; F21V 23/0478;
(Continued)

(56) References Cited

U.S. PATENT DOCUMENTS 4,630,184 A * 12/1986 Ferrero ..... F21S 48/2218 362/293
4,817,163 A * 3/1989 Stastny ..... A63J 17/00 181/148
(Continued)

FOREIGN PATENT DOCUMENTS

JP 2008-193189 A 8/2008
JP 2010-015754 A 1/2010
(Continued)

OTHER PUBLICATIONS

International Search Report corresponding to PCT/JP2013/001726, dated Jun. 11, 2013, 2 pgs.
(Continued)

*Primary Examiner* — Peggy Neils
(74) *Attorney, Agent, or Firm* — Lerner, David, Littenberg, Krumholz & Mentlik, LLP

(57) ABSTRACT

To provide an electric light bulb type light source apparatus capable of reducing backlash, which results in noise, and improving the sound quality of a speaker. The electric light bulb type light source apparatus may include a speaker, a light source unit, a supporting unit, a casing, and a base. The supporting unit may support the speaker. The supporting unit may include a base portion. The base portion may include a tapered surface and a supporting surface that supports the light source unit. The casing may include an abutting surface that abuts against the tapered surface of the base portion. The base maybe used for supplying a power to the light source unit and the speaker.

5 Claims, 16 Drawing Sheets

(51) Int. Cl.

| | |
|---|---|
| ***F21V 3/02*** | (2006.01) |
| ***H04R 1/02*** | (2006.01) |
| ***F21V 3/00*** | (2015.01) |
| ***F21K 9/232*** | (2016.01) |
| *F21V 3/04* | (2006.01) |
| *F21V 19/00* | (2006.01) |
| *F21V 23/04* | (2006.01) |
| *F21V 29/506* | (2015.01) |
| *F21V 29/85* | (2015.01) |
| *F21V 29/87* | (2015.01) |
| *F21V 29/89* | (2015.01) |
| *F21W 131/30* | (2006.01) |
| *F21K 9/61* | (2016.01) |
| *F21Y 103/33* | (2016.01) |
| *F21Y 115/10* | (2016.01) |

(52) U.S. Cl.

CPC ..... *F21V 3/02* (2013.01); *H04R 1/028* (2013.01); *F21K 9/61* (2016.08); *F21V 3/0418* (2013.01); *F21V 3/0436* (2013.01); *F21V 19/0055* (2013.01); *F21V 23/0442* (2013.01); *F21V 23/0478* (2013.01); *F21V 29/506* (2015.01); *F21V 29/86* (2015.01); *F21V 29/87* (2015.01); *F21V 29/89* (2015.01); *F21W 2131/30* (2013.01); *F21Y 2103/33* (2016.08); *F21Y 2115/10* (2016.08); *H04R 1/025* (2013.01); *H04R 2201/021* (2013.01); *H04R 2201/028* (2013.01); *H04R 2420/07* (2013.01)

(58) Field of Classification Search

CPC .... F21V 29/506; F21V 29/86; F21V 33/0056; F21V 3/00; F21V 3/02; F21V 3/0418; F21V 3/0436; F21V 19/0055; F21Y 2101/02; F21Y 2103/022; H01R 2420/07; H04R 2420/07

See application file for complete search history.

(56) References Cited

U.S. PATENT DOCUMENTS

| | | | | |
|---|---|---|---|---|
| 5,032,960 | A * | 7/1991 | Katoh | F21V 5/04 355/70 |
| 6,871,981 | B2 * | 3/2005 | Alexanderson | B60Q 3/025 362/294 |
| 7,784,957 | B2 * | 8/2010 | Wright | H04R 1/028 362/234 |
| 7,874,699 | B2 * | 1/2011 | Liang | F21K 9/233 362/249.02 |
| 8,066,392 | B2 * | 11/2011 | Wang | F21S 9/022 362/20 |
| 8,087,804 | B2 * | 1/2012 | Sun | F21K 9/00 362/294 |
| 8,525,395 | B2 * | 9/2013 | Muessli | F21V 29/004 313/46 |
| 9,228,731 | B2 * | 1/2016 | Chen | H04N 7/183 |
| 2010/0103664 | A1 * | 4/2010 | Simon | F21K 9/135 362/234 |
| 2010/0289396 | A1 | 11/2010 | Osawa et al. | |
| 2011/0032708 | A1 | 2/2011 | Johnston et al. | |
| 2011/0064258 | A1 * | 3/2011 | Aggarwal | H04S 7/302 381/394 |
| 2011/0254426 | A1 | 10/2011 | Wang | |
| 2013/0201696 | A1 | 8/2013 | Hisayasu et al. | |

FOREIGN PATENT DOCUMENTS

| | | | |
|---|---|---|---|
| JP | 2010-056059 | A | 3/2010 |
| JP | 2010-198807 | A | 9/2010 |
| JP | 2010-282841 | A | 12/2010 |
| JP | 3165464 | U | 1/2011 |
| JP | 2011-077015 | A | 4/2011 |
| JP | 2011-204637 | A | 10/2011 |
| JP | 2011-222468 | A | 11/2011 |
| JP | 2011-253809 | A | 12/2011 |
| JP | 2012-028245 | A | 2/2012 |
| JP | 3174462 | U | 3/2012 |
| WO | 2011049435 | A1 | 4/2011 |
| WO | 2011117691 | A1 | 9/2011 |
| WO | 2012/043586 | A1 | 4/2012 |
| WO | 2012049695 | A1 | 4/2012 |

OTHER PUBLICATIONS

Japanese Office Action for JP Application No. 2014512311, dated Dec. 15, 2015.

Partial European Search Report for EP Application No. 13780969.5, dated Oct. 28, 2015.

Extended European Search Report for EP Application No. 13780969.5, dated Feb. 23, 2016.

Japanese Office Action for Application No. 2014-512311 dated Sep. 6, 2016.

Japanese Office Action for Application No. 2016-235583 dated Sep. 26, 2017.

* cited by examiner

ELECTRIC LIGHT BULB TYPE LIGHT SOURCE APPARATUS AND TRANSLUCENT COVER

CROSS-REFERENCE TO RELATED APPLICATION

The present application is a national phase entry under 35 U.S.C. §371 of International Application No. PCT/JP2013/001726 filed Mar. 14, 2013, published on Oct. 31, 2013 as WO 2013/161164 A1, which claims priority from Japanese Patent Application No. JP 2012-102465 filed in the Japanese Patent Office on Apr. 27, 2012 and JP 2012-102504, filed in the Japanese Patent Office on Apr. 27, 2012.

TECHNICAL FIELD

The present technology relates to an electric light bulb type light source apparatus and to a translucent cover used therefor.

BACKGROUND ART

As an electric light bulb type illumination apparatus, Patent Document 1 describes an illumination apparatus equipped with a speaker. This illumination apparatus includes a cylindrical casing, a speaker provided at a center of a front surface of the casing, and a plurality of light emitting diode (LED) elements arranged around the speaker, similarly on the front surface of the casing. Further, various circuit substrates including drive circuits and the like of the LEDs and the speaker are housed in the casing. The speaker converts electrical signals input into the drive circuit into sound waves through vibration of a diaphragm and emits the sound waves to the outside, to thereby output them as, for example, audio (e.g., see FIG. 1).

Patent Document 2 discloses an LED bulb that includes light emitting diodes (LEDs) covered with a globe having an incandescent light bulb shape and emits light from the LEDs to the outside. In this LED bulb, an LED module on which the LEDs are mounted and the globe that covers this LED module are mounted on a heat dissipating unit. Further, a ring-like reflecting plate is provided in a junction portion between the heat dissipating unit and the globe. With this, light beams of light diffused by the globe, which are rearwardly directed, are reflected to the globe. In this manner, a loss of light not emitted to the outside of the LED bulb is reduced (e.g., see FIG. 8).

Patent Document 1: Japanese Patent Application Laid-open No. 2008-193189

Patent Document 2: Japanese Patent Application Laid-open No. 2010-056059

SUMMARY OF INVENTION

Problem to be Solved by the Invention

If an apparatus functions as the speaker as in the illumination apparatus of Patent Document 1, it is necessary to suppress the generation of so-called chattering noise, which is noise in the output of the speaker. For example, it is conceivable that if adjacent members have a gap therebetween in this illumination apparatus and vibration of the speaker is transmitted to these members, chattering noise due to the backlash is caused, which deteriorates the sound quality of the speaker.

In an electric light bulb type light source apparatus, the light reflection or the like is sometimes used to efficiently use light from a light source for illumination outside of the apparatus as in the LED bulb of Patent Document 2. How to take out the light from the light source affects the outer appearance of the apparatus. Thus, it is necessary to improve the outer appearance of the electric light bulb type light source apparatus.

In view of the above-mentioned circumstances, it is an object of the present technology to provide an electric light bulb type light source apparatus capable of reducing backlash, which results in noise, and improving the sound quality of a speaker.

It is another object of the present technology to provide an electric light bulb type light source apparatus having improved outer appearance.

Means for Solving the Problem

In order to achieve the objects above, an electric light bulb type light source apparatus according to the present technology includes: a speaker; a light source unit; a supporting unit; a casing; and a base.

The supporting unit supports the speaker. The supporting unit includes a base portion. The base portion includes a tapered surface and a supporting surface that supports the light source unit.

The casing includes an abutting surface against which the tapered surface of the base portion abuts.

The base is used for supplying a power to the light source unit and the speaker.

The surface of the supporting unit that supports the speaker, which abuts against the casing has a tapered shape, and hence it is possible to reduce backlash between the supporting unit and the casing. Thus, even if vibration of the speaker is transmitted to the supporting unit and the casing, it is possible to reduce the backlash, which results in noise, and improve the sound quality of the speaker.

The supporting unit, the speaker, and the base may be arranged such that the base portion is disposed between the speaker and the base. The supporting unit may further include a holding portion that holds the speaker. In this case, the holding portion holds the speaker such that the supporting surface of the base portion faces the speaker. Further, the base portion is disposed around the holding portion.

The holding portion of the supporting unit can stably support the speaker without interfering with the arrangement of the light source unit.

The tapered surface of the base portion may be a surface formed to approach a center of the base portion as a distance from the supporting surface increases. The holding portion is located at the center of the base portion.

The tapered surface is supported by the abutting surface of the casing from a side of the base, such that the position of the base portion can be made stable and the backlash can be reduced.

The casing may include a base casing including a tapered surface that abuts against the tapered surface of the base portion as the abutting surface.

By the tapered surfaces abutting against each other, the gap between the base portion and the base casing can be reduced, and hence it is possible to suppress the generation of noise.

The supporting unit may include a heat sink that forms at least a part of the base portion. In this case, the casing includes a base casing including the abutting surface, which is thermally connected to the heat sink.

Even if the heat sink and the base casing are separate members, the backlash between the members can be reduced by the abutting surface of the base casing supporting the tapered surface of the base portion including the heat sink from the side of the base.

The tapered surface of the base portion may be a surface formed to be spaced apart from a center of the base portion, at which the holding portion is located, as a distance from the supporting surface increases.

The member serving as the casing on the side of the speaker can be stably supported by the tapered surface.

The casing may include a translucent cover including a tapered surface that abuts against the tapered surface of the base portion as the abutting surface.

By the tapered surfaces abutting against each other, the gap between the base portion and the translucent cover can be reduced, and hence the generation of noise can be suppressed.

The translucent cover may include a first opening portion and a second opening portion. The first opening portion includes the tapered surface serving as the abutting surface. The second opening portion is provided to be closed by the speaker.

The translucent cover is provided such that the position on the base portion becomes stable by causing the tapered surface of the first opening portion against the tapered surface of the base portion. By this translucent cover being pushed by the speaker supported by the supporting unit from a side of the second opening portion, assembling is performed for reducing the backlash.

The electric light bulb type light source may further include a packing provided between the speaker and the translucent cover.

By the packing being interposed in the structure in which the opening portion of the translucent cover on the side of the speaker is closed, the gap between the speaker and the translucent cover can be reduced. In addition to the reduction in the gap between the base portion and the translucent cover, an effect of making the space surrounded with the translucent cover more air-tight can be obtained. Thus, it is possible to provide the space surrounded with the translucent cover with the speaker box function and improve the sound quality of the speaker.

The tapered surface of the supporting unit may have a taper angle of 30 degrees or more and 60 degrees or less. By the tapered surface tilted in this manner being abutted against the abutting surface, it is possible to stabilize the position relationship between the supporting unit and the casing not only in a horizontal direction but also in a vertical direction.

The light source unit may include a light emitting diode (LED) or an electro luminescence (EL) element as a light source element.

An electric light bulb type light source apparatus according to the present technology includes: a speaker; a light source unit; a supporting unit; a casing; and a base.

The supporting unit supports the light source unit and the speaker.

The casing houses the light source unit and the supporting unit. The casing includes a base casing and a translucent cover. The base casing includes a tapered surface. The translucent cover includes an abutting surface that abuts against the tapered surface.

The base is used for supplying a power to the light source unit and the speaker.

A surface that abuts against the translucent cover of the base casing has a tapered shape, and hence it is possible to reduce the backlash, which results in noise, even if the vibration of the speaker is transmitted to the casing formed by combining the base casing with the translucent cover.

The supporting unit includes a holding portion and a base portion. The holding portion holds the speaker. The base portion is disposed around the holding portion. The base portion supports the light source unit. The supporting unit, the speaker, and the base are arranged such that the base portion is disposed between the speaker and the base.

The base casing may include an opening end surface. The base portion is placed in the opening end surface. In this case, the tapered surface is disposed around the opening end surface. The tapered surface is a surface formed to approach the base along a direction, in which the speaker, the base portion, and the base are arranged, as a distance from the opening end surface increases.

Due to this tapered surface, the translucent cover can be stably disposed at a position of the opening end surface of the base casing on a radially outer side with respect to the opening end surface.

The translucent cover may include a tapered surface that abuts against the tapered surface of the base casing as the abutting surface.

The casing can be formed not to form a gap by the tapered surfaces abutting against each other, and hence the generation of noise can be suppressed.

In order to achieve another object above, an electric light bulb type light source apparatus according to the present technology includes: a speaker; a light source unit; a translucent cover; a supporting unit; and a base.

The translucent cover includes a first opening, an input end surface of light that forms the first opening, a second opening, and an output end surface that forms the second opening and outputs light, and guides light from the input end surface to the output end surface.

The supporting unit includes an opposed surface that is disposed to be opposed to the input end surface and a holding portion that holds the speaker such that the speaker is placed in the second opening, and supports the speaker and the light source unit.

The base is used for supplying a power to the light source unit and the speaker.

The supporting unit includes the opposed surface opposed to the input end surface that forms the first opening of the translucent cover, and hence the light emitted from the opposed surface enters the input end surface, is guided in the translucent cover, and emitted from the output end surface that forms the second opening. Thus, the speaker is placed in the second opening, and hence the light from the opposed surface seems to be emitted from around the speaker and the outer appearance is improved.

The supporting unit may include a heat sink including the opposed surface and a supporting surface that supports the light source unit. With this, the electric light bulb type light source apparatus can exert a heat dissipation function and can support the translucent cover by the use of the heat sink.

The opposed surface may be a tapered surface formed in the heat sink. With this, the fixing state of the translucent cover and the heat sink is made stable and the entire rigidity of the translucent cover and the heat sink can be increased. Further, by the input end surface of the translucent cover abutting against the tapered surface, the gap between the translucent cover and the heat sink can be reduced. Thus, it is possible to prevent noise (chattering noise), which is caused by the vibration of the speaker, from being generated.

The heat sink may be formed in a ring shape around the holding portion. With this, the heat sink can support the ring-like light source unit.

The supporting unit may include a base casing including the opposed surface. With this, the electric light bulb type light source apparatus can support the translucent cover by the use of the base casing.

The opposed surface may be a tapered surface formed in the base casing. With this, the fixing state of the translucent cover and the base casing becomes stable, and the entire rigidity of the translucent cover and the base casing can be improved. Further, by the input end surface of the translucent cover abutting against the tapered surface, the gap between the translucent cover and the base casing can be reduced and it is possible to prevent noise (chattering noise), which is caused by the vibration of the speaker, from being generated.

The supporting unit may include a heat sink formed in a ring shape around the holding portion and supporting the light source unit. In this case, the base casing may include an opening in which the heat sink is placed. With this, the base casing can support the heat sink.

The base casing may include a tapered abutting surface that forms an end surface of the opening together with the opposed surface, against which the heat sink abuts. With this, the supporting unit can stably support the heat sink by the use of the base casing. Further, by the heat sink abutting against the tapered abutting surface, the gap between the heat sink and the base casing can be reduced. Thus, it is possible to prevent noise (chattering noise), which is caused by the vibration of the speaker, from being generated.

The input end surface of the translucent cover or the opposed surface of the supporting unit may include a colored region that is colored to reflect color light. With this, the translucent cover can emit colored light in the colored region from the output end surface, and hence the region around the speaker seems to be colored, which contributes to an improvement of the appearance.

Another electric light bulb type light source apparatus according to the present technology may include a sensor instead of the above-mentioned speaker.

A translucent cover according to the present technology includes an input end surface and an output end surface.

The input end surface forms a first opening in which an opposed surface provided in a supporting unit that supports a speaker and a light source unit can be placed, upon which light is incident.

The output end surface forms a second opening in which the speaker supported by the supporting unit can be placed, from which light is emitted.

Further, the translucent cover covers the light source unit supported by the supporting unit and guides the light incident upon the input end surface to the output end surface.

The supporting unit includes the opposed surface opposed to the input end surface that forms the first opening of the translucent cover, and hence light emitted from the opposed surface enters the input end surface, is guided in the translucent cover, and emitted from the output end surface that forms the second opening. Thus, the sensor is placed in the second opening, and hence the light from the opposed surface seems to be emitted from around the sensor and the outer appearance is improved.

Effect of the Invention

As described above, according to the present technology, it is possible to provide an electric light bulb type light source apparatus capable of reducing backlash, which results in noise, and improving the sound quality of a speaker.

Further, according to the present technology, it is possible to improve the outer appearance of the electric light bulb type light source apparatus.

MODE(S) FOR CARRYING OUT THE INVENTION

Hereinafter, embodiments of the present technology will be described with reference to the drawings.

First Embodiment (Entire Configuration of Electric Light Bulb Type Light Source Apparatus)

Figure 1:
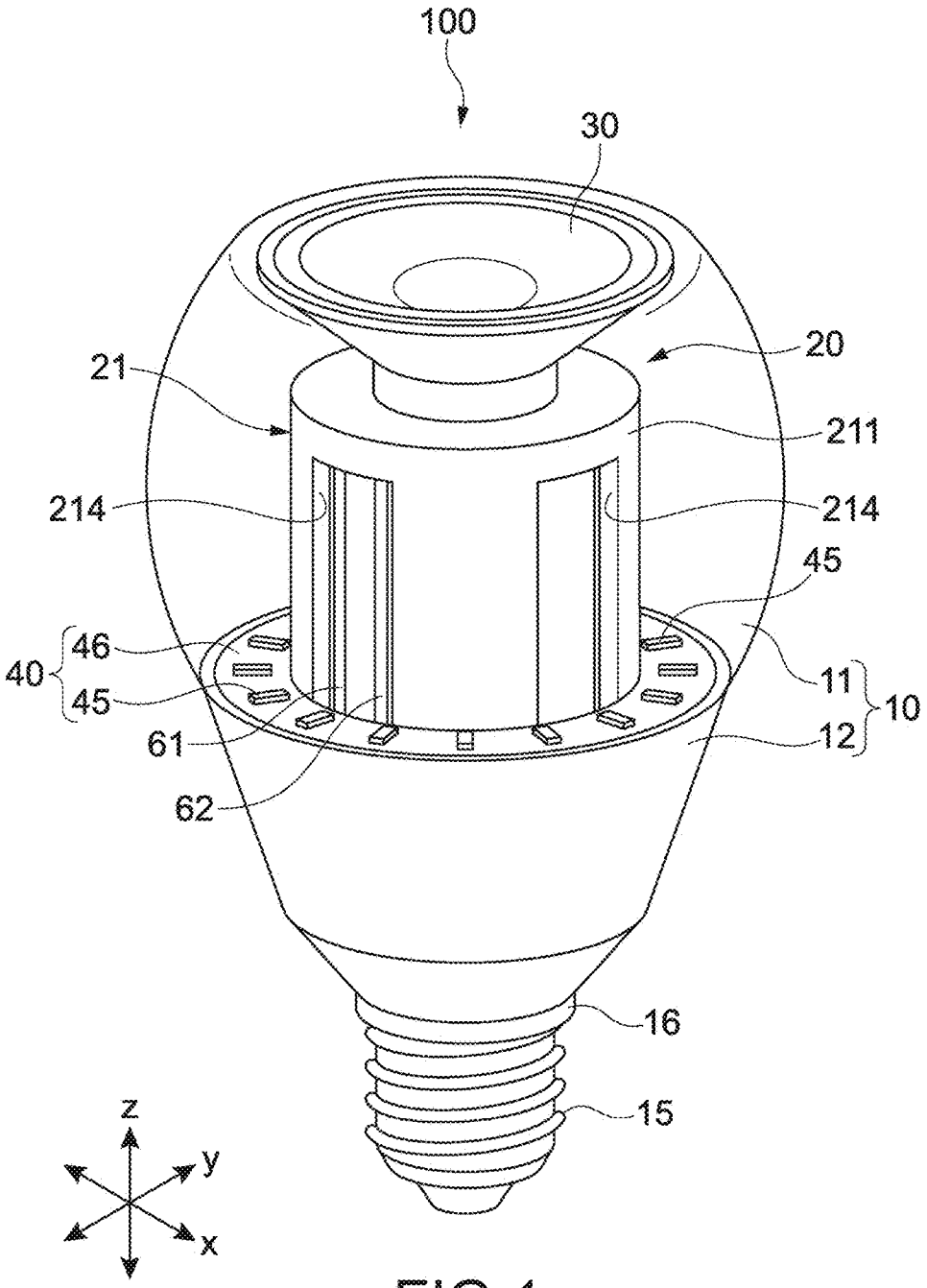
FIG. 1 A perspective view showing an electric light bulb type light source apparatus according to an embodiment of the present technology.
Figure 2:
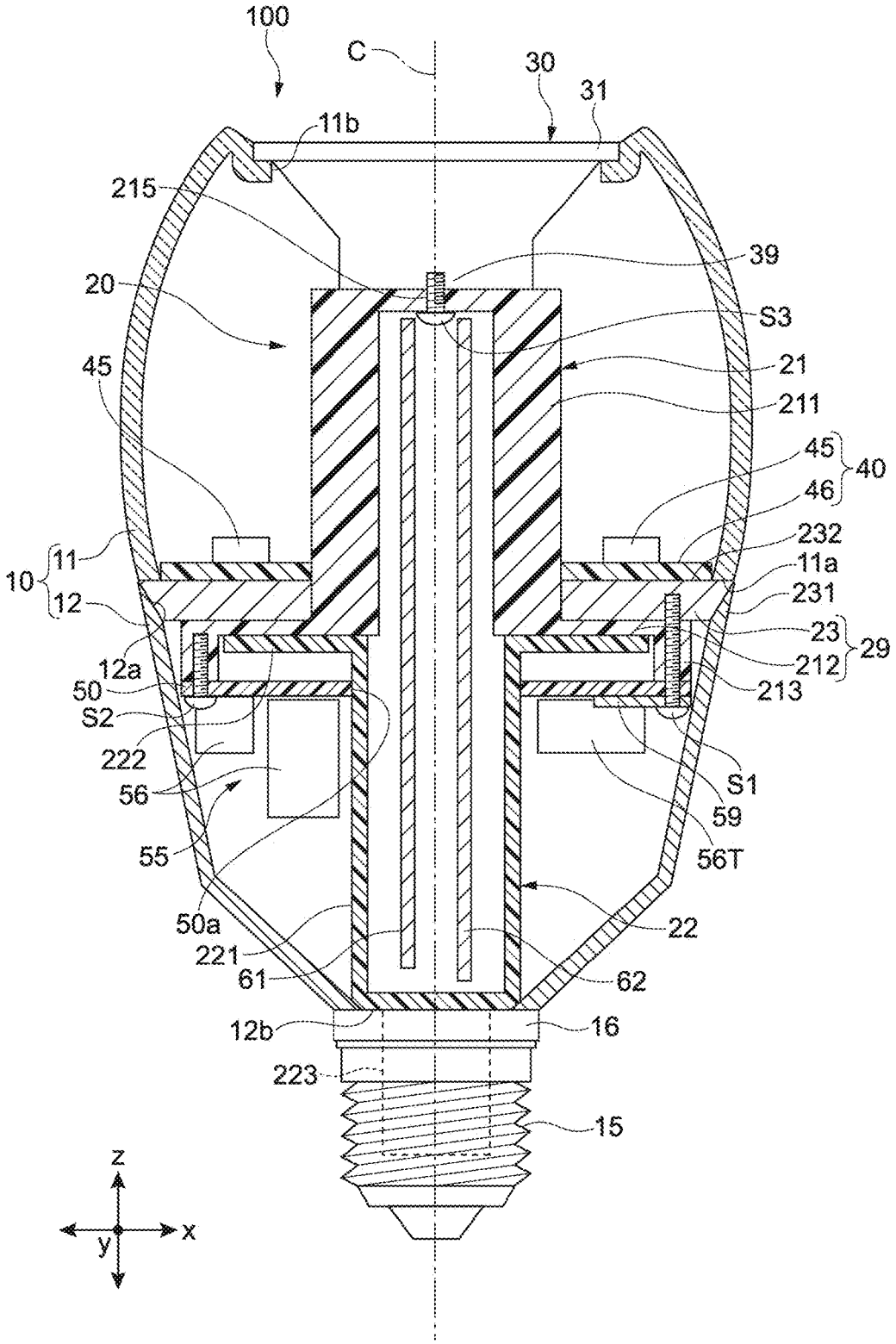
FIG. 2 A schematic cross-sectional view of the electric light bulb type light source apparatus shown in FIG. 1.

FIG. 1 is a perspective view showing an electric light bulb type light source apparatus according to an embodiment of the present technology. FIG. 2 is a schematic cross-sectional view of the electric light bulb type light source apparatus 100 shown in FIG. 1. In the following description, the electric light bulb type light source apparatus will be simply referred to as a light source apparatus.

A light source apparatus 100 includes a casing 10, a light source unit 40 placed in the casing 10, a speaker 30 provided on one end portion of the casing 10, and a base 15 that is connected to the other end portion of the casing 10 (opposite side of speaker 30) via an insulating ring 16 being an electrical insulator.

For the sake of description, the descriptions will be made hereinafter assuming that a direction along a z-axis in FIGS. 1 and 2 is front and rear directions of the light source apparatus 100, specifically, a side of the speaker 30 is a front side and a side of the base 15 is a rear side.

The casing 10 includes, for example, a base casing 12 and a translucent cover 11 provided on the front side of the base casing 12. As shown in FIG. 2, a second opening portion 11*b* and a first opening portion 11*a* are formed in the translucent cover 11. The second opening portion 11*b* is provided in an end portion on the front side. The first opening portion 11*a* is located on the opposite side thereof along a z-axis direction. The speaker 30 is provided to close the second opening portion 11*b*. The base casing 12 is provided on a side of the first opening portion 11*a* of the translucent cover 11. The translucent cover 11 is formed of, for example, glass, acrylic, or polycarbonate.

The light source apparatus 100 includes a supporting unit 20 that supports the speaker 30. The supporting unit 20 includes a tubular holding portion 211 that holds the speaker 30 and a base portion 29 disposed around this holding portion 211. The light source unit 40 is supported by the base portion 29 of the supporting unit 20. The supporting unit 20 integrally supports the light source unit 40, the speaker 30, and the base 15 such that the light source unit 40 is disposed between the speaker 30 and the base 15 with the speaker 30 and the light source unit 40 being spaced apart from each other. With this, the supporting unit 20, the speaker 30, and the base 15 are arranged such that the base portion 29 is disposed between the speaker 30 and the base 15.

As shown in FIG. 2, the supporting unit 20 typically includes a heat sink 23, a holding material 21 that is fixed to this heat sink 23 and holds the speaker 30, and a substrate housing box 22 that is disposed to be opposed to the holding material 21. The holding material 21 is a member including the holding portion 211 of the supporting unit 20. The heat sink 23 is a member that forms at least a part of the base portion 29.

The heat sink 23 of the supporting unit 20 functions as a chassis of this light source apparatus 100. The heat sink 23 is disposed around a center axis C (see FIG. 2) being an axis passing through a center of the speaker 30 along a vibration direction (z-axis direction) of a diaphragm 35 (see FIG. 3) of the speaker 30. "Around the axis" includes both concepts of entirely around the axis and partially around it. Typically, the heat sink 23 has a plate shape and is formed entirely around the center axis C, that is, in a ring shape.

The light source unit 40 is disposed around the center axis C as in the heat sink 23. Typically, the light source unit 40 is formed in a ring shape and disposed on the heat sink 23. For example, the light source unit 40 includes a ring-like mounting substrate 46 and a plurality of LED (Light Emitting Diode) elements 45 arranged in a ring shape on the mounting substrate 46. Although an element that generates white light is used as one LED element 45, an element that generates single color light or multiple color light other than the white light may be used. The mounting substrate 46 is connected to the heat sink 23 with a screw (not shown), for example. With this, the supporting unit 20 may integrally support the light source unit 40.

Although the heat sink 23 is mainly formed of, for example, aluminum, another metal material such as copper may be used as long as it is a material having a relatively high thermal conductivity.

The base 15 is configured to be mountable on a socket for a general incandescent light bulb. The base 15 is a member that supplies a power to a circuit substrate on which various circuits are mounted, the light source unit 40, and the speaker 30 via a power-supply circuit 55 to be described later.

A length of the light source apparatus 100 in the z-axis direction is 100 to 120 mm, typically, about 110 mm. A diameter of the light source apparatus 100 as viewed in the z-axis direction is 50 to 70 mm, typically, about 60 mm.

(Specific Configuration of Speaker)

Figure 3:
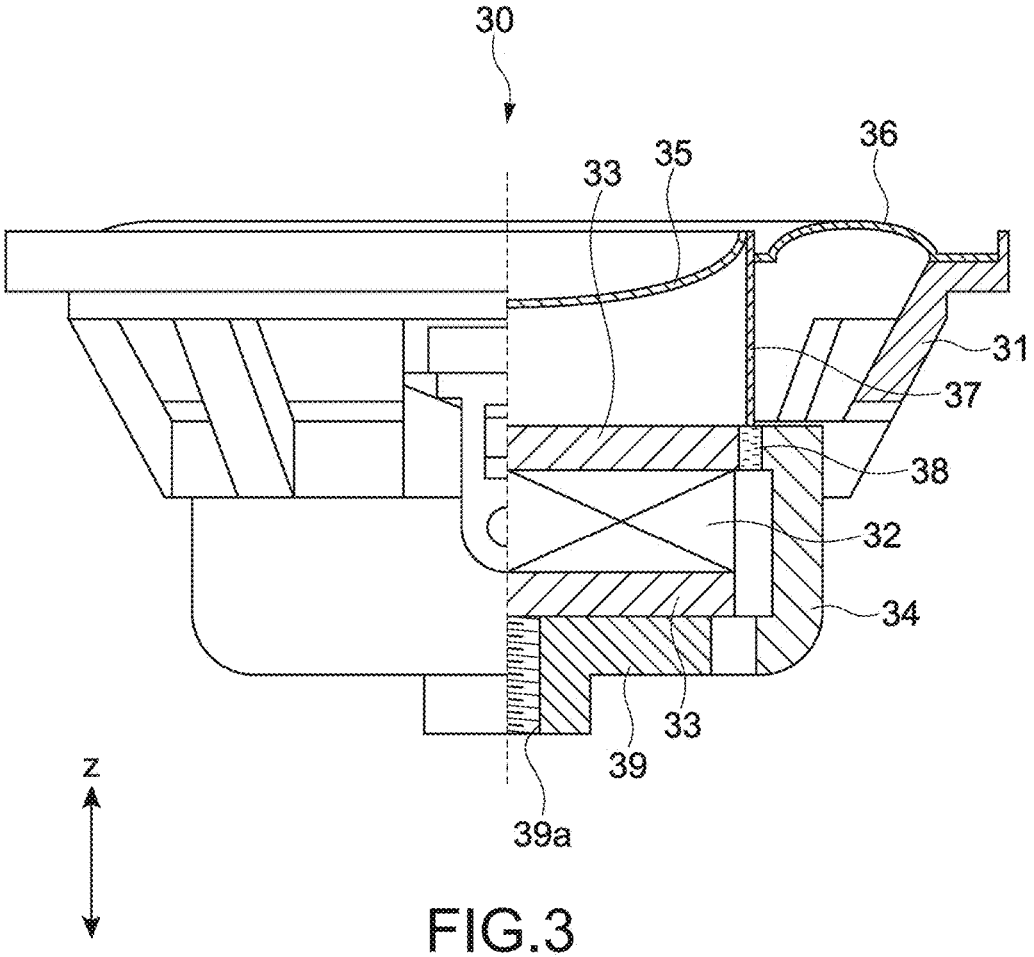
FIG. 3 A cross-sectional view showing a speaker according to the embodiment.

FIG. 3 is a cross-sectional view showing the speaker 30 according to the embodiment. This speaker 30 is a damperless dynamic speaker. The speaker 30 includes a frame 31, a permanent magnet 32, plates 33, a yoke 34, the diaphragm 35, an edge 36, a coil bobbin 37, a magnetic fluid 38, and an attachment bottom portion 39.

The magnetic fluid 38 that replaces the conventional damper is provided between a magnetic gap between the yoke 34 and the upper plate 33. A voice coil (not shown) is also provided in this magnetic gap. A screw hole 39*a* is formed in the attachment bottom portion 39. As will be also described later, the speaker 30 is fixed to the holding material 21 of the supporting unit 20 via this screw hole 39*a* with a screw S3 (see FIG. 2).

As will be also described later, in this embodiment, the speaker 30 and the light source unit 40 are provided spaced apart from each other, and hence the speaker 30 is unlikely to be affected by the heat of the light source unit 40. Thus, as the permanent magnet 32 used for the speaker 30, a permanent magnetic having a relatively low thermal resistance, that is, a relatively low demagnetization temperature. For example, a permanent magnetic having a demagnetization temperature of 60° C. or more to 100° C. or less can be used. Neodymium is exemplified as a permanent magnetic having a demagnetization temperature of 100° C. or less.

A magnetic force of the neodymium magnet is higher than a magnetic force of a ferrite core magnet or the like. The demagnetization temperature of the neodymium is about 80° C. and relatively lower than that of the ferrite. If the ferrite core magnet is applied to the speaker 30 of the light source apparatus 100 according to this embodiment, the ferrite core magnet has to be increased in size in order to obtain a magnetic force equal to that of the neodymium magnet, and hence it is not suitable for downsizing of the light source apparatus 100. Reducing the heat generated by the light source unit 40 in order to prevent the permanent magnet from being demagnetized is conceivable. However, it means reducing an input power to the light source apparatus 100 and the luminous flux decreases.

Therefore, in this embodiment, the neodymium having a lower thermal resistance than that of the ferrite but having a larger magnetic force than that of the ferrite is used and the speaker 30 and the light source unit 40 are provided spaced apart from each other, to thereby solve the above problem.

For example, at least a part of the frame 31 of the speaker 30 and at least a part of the edge 36 may be formed of a translucent material. As the translucent material, a well-known material such as an acrylic-based resin material, a polyvinyl-based resin material, and a polyimide-based resin material are used. With this, light emitted from the light source unit 40 passes through a part of the speaker 30, and hence it is possible to increase light distribution characteristics leaning to the center of the light source apparatus 100.

(Specific Configuration of Supporting Unit)

Figure 4:
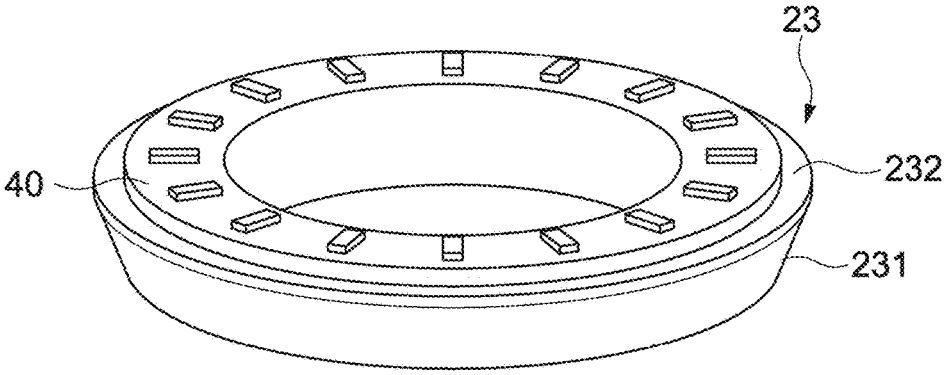
FIG. 4 A perspective view showing a heat sink of a base portion of a supporting unit.

FIG. 4 is a perspective view showing the heat sink 23 of the base portion 29 of the supporting unit 20. As shown in FIG. 2, the base portion 29 of the supporting unit 20 includes a tapered surface 231 and a supporting surface 232 that supports the light source unit 40. As shown in FIG. 4, the tapered surface 231 and the supporting surface 232 typically includes the heat sink 23. As shown in FIG. 2, the supporting surface 232 of the heat sink 23 faces the speaker 30.

The tapered surface 231 is a surface formed to approach a center of the base portion 29 as a distance from the supporting surface 232 increases. "The center of the base portion 29" means a position of the holding portion 211 surrounded by the base portion 29, typically, a position which the center axis C (see FIG. 2) passes through. As shown in FIG. 4, the tapered surface 231 is provided on a side of the heat sink 23, which is opposite to the supporting surface 232, and tilted such that the outer periphery of the heat sink 23 is reduced in diameter as approaching the side of the base 15 (rear side). A taper angle of this tapered surface 231 with respect to the x-y plane is, for example, 30 degrees or more and 60 degrees or less.

Figure 5:
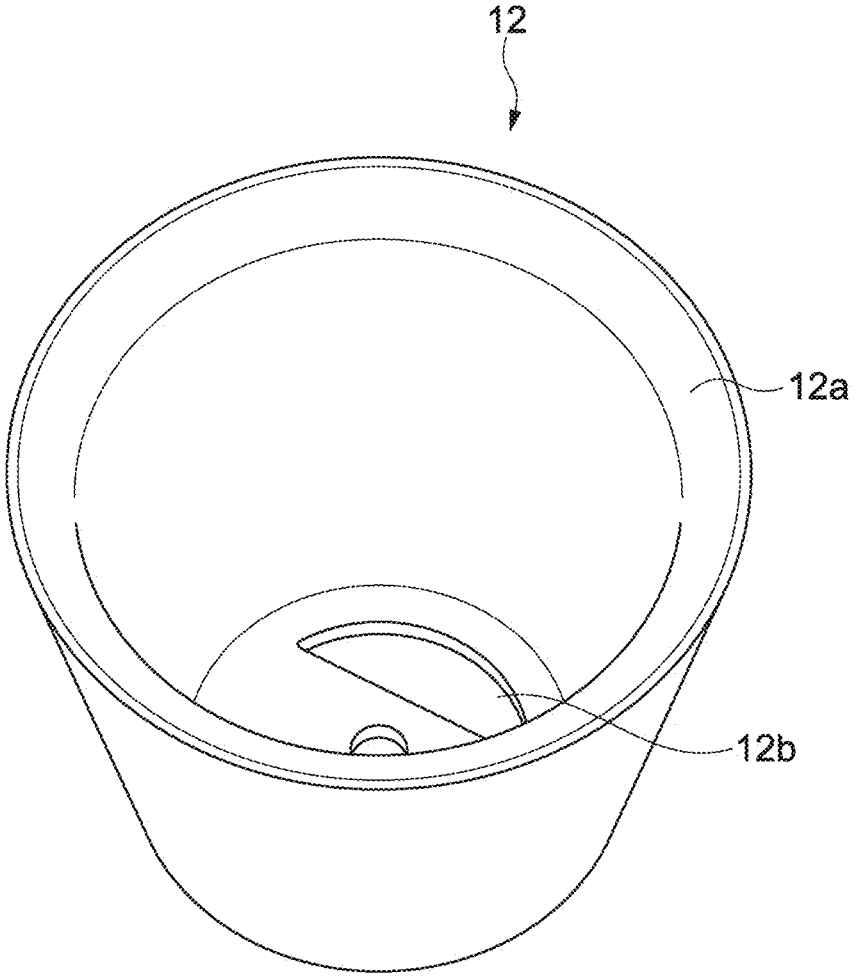
FIG. 5 A perspective view showing a base casing on which the heat sink is provided.

FIG. 5 is a perspective view showing the base casing 12 in which the heat sink 23 is provided. As shown in FIG. 5, the base casing 12 is opened at one end side (front side) (in bowl shape) and includes a tapered abutting surface 12*a* at an opened end portion thereof. As shown in FIG. 2, the tapered surface 231 of the heat sink 23 abuts against the abutting surface 12*a*. Typically, a tapered surface along the tapered surface 231 is formed as the abutting surface 12*a* on an inner peripheral side of the opening end portion of the base casing 12. The supporting unit 20 is disposed on the opening end portion on the front side of the base casing 12 such that the tapered surface 231 is fitted into the abutting surface 12*a*.

Figure 6:
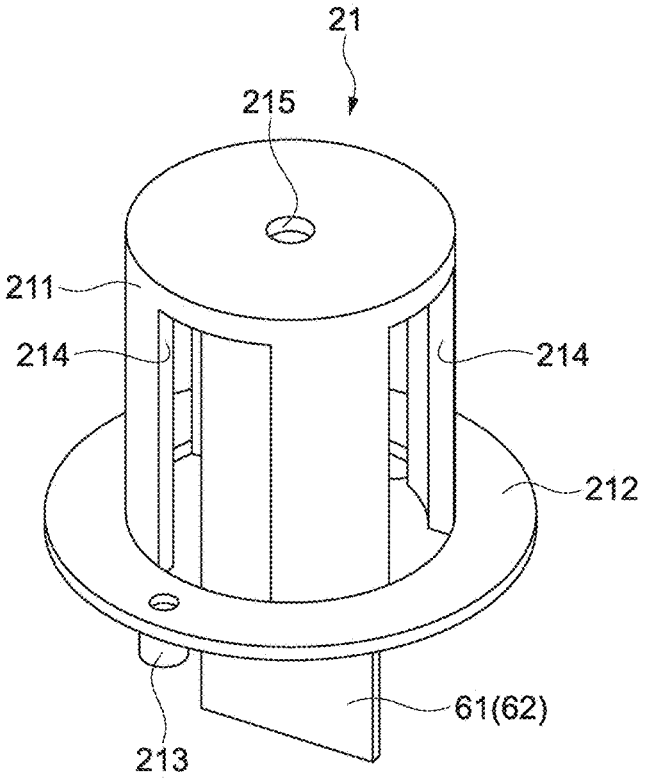
FIG. 6 A perspective view showing a holding material of the supporting unit.

FIG. 6 is a perspective view showing the holding material 21 of the supporting unit 20. The holding material 21 includes the holding portion 211 on which the speaker 30 is mounted and a flange portion 212 provided to an end portion on the rear side of the holding portion 211. The holding material 21 is placed in the casing 10 such that the holding portion 211 passes through holes at centers of the heat sink 23 and the light source unit 40 and the holding portion 211 has a longitudinal direction in the z-axis direction.

A screw hole 215 is provided in an end surface on the front side of the holding portion 211. The screw S3 (see FIG. 2) is inserted in the screw hole 39*a* formed in the screw hole 215 and the speaker 30. With this, the speaker 30 is held by the holding material 21. The means for mounting the speaker 30 on the holding material 21 is not limited to screwing and may be adhesion with an adhesive or engagement of concave and convex members.

As shown in FIG. 2, the holding material 21 is fixed to the heat sink 23 with a screw S1. Specifically, a fixing portion 213 for screwing is formed in the flange portion 212 of the holding material 21 to protrude to the rear side. The heat sink 23 is disposed on the flange portion 212 and the holding material 21 is fixed to the heat sink 23 via the fixing portion 213 from a rear surface side (rear side) of the heat sink 23.

As described above, the heat sink 23 mainly forms the base portion 29 of the supporting unit 20. The base portion 29 of the supporting unit 20 also includes the flange portion 212 of the holding material 21. The supporting unit 20 holds the speaker 30 through the holding portion 211 of the holding material 21 such that the supporting surface 232 of the base portion 29 faces the speaker 30. The thus configured supporting unit 20 can stably support the speaker 30 without interfering with the arrangement of the light source unit 40 provided in the supporting surface 232 of the base portion 29.

With such configurations of the holding material 21 and the heat sink 23, as also described above, the light source unit 40 is provided spaced apart from the speaker 30 on the rear side, and hence it is possible to reduce the thermal effect of the light source unit 40 on the speaker 30. With this, it is possible to favorably maintain the function of the speaker 30. For example, if the thermal effect on the speaker 30 is large, there is a fear that the permanent magnet 32 provided in the speaker 30 is demagnetized. However, with the light source apparatus 100 according to this embodiment, such a fear can be eliminated.

Further, although the speaker 30 is disposed on the light outputting side of the light source unit 40, that is, in the position in which it shields the output light, the light source unit 40 is formed in a ring shape, and hence a light distribution angle is increased. Further, the light source unit 40 can evenly distribute light with respect to the center axis C.

In this embodiment, the holding portion 211 of the holding material 21 that holds the speaker 30 is disposed at the center of the base portion 29 that supports the light source unit 40. Therefore, it is possible to reduce the arrangement space for the holding material 21 and the light source unit 40 in the electric light bulb type light source apparatus 100 and thus to increase the arrangement density of these members. Thus, it is possible to downsize the light source apparatus 100 even while ensuring a desired light distribution angle.

The holding portion 211 of the holding material 21 may be provided with a reflecting portion that reflects light emitted from the light source unit 40. The reflecting portion is, for example, a mirror surface or a portion made of a material having a color with a high optical reflectance. The color with a high optical reflectance is, for example, white, milky white, or a color close thereto. Of course, the holding material 21 itself may be made of a white or milky white resin material. Although acrylonitrile butadiene styrene (ABS), polybutylene terephthalate (PBT), or the like is used as the resin material, another material may be used. The reflecting portion may be provided as a member separated from the holding portion 211 of the holding material 21.

Further, if the reflecting portion is made of the material in white, milky white, or the like, the reflecting portion can diffuse and reflect (scatter) light. Alternatively, also if the reflecting portion is a reflecting surface subjected to blasting, the reflecting surface can diffuse and reflect light.

As described above, by the provision of the reflecting portion, it is possible to increase the light distribution angle of the output light from the light source unit 40 and to efficiently use the light of the light source unit 40. Thus, it is possible to increase the intensity of illumination.

Figure 7:
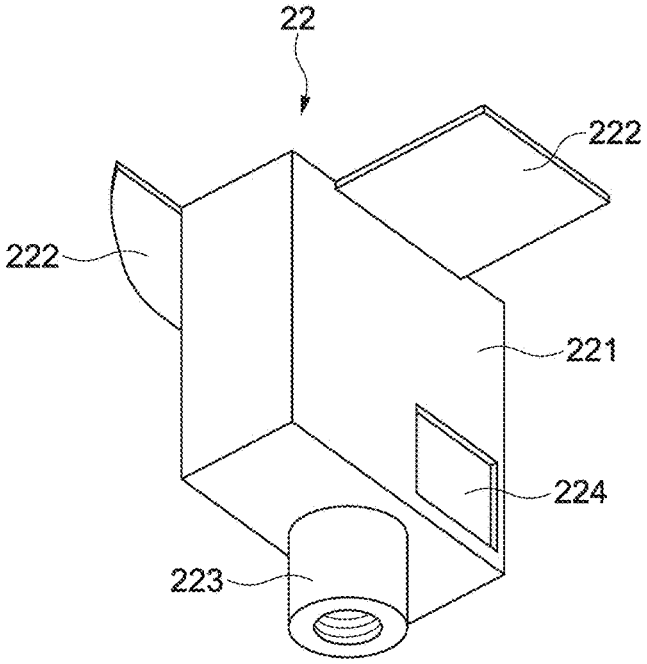
FIG. 7 A perspective view as a substrate housing box of the supporting unit is viewed from below.

FIG. 7 is a perspective view as the substrate housing box 22 of the above-mentioned supporting unit 20 is viewed from below. The substrate housing box 22 includes a main body 221, abutting plates 222 that are provided to protrude from the main body 221 in a direction perpendicular to the z-axis, and a protrusion 223 that is provided to protrude from the main body 221 in the z-axis direction. In FIG. 7, although the plurality of abutting plates 222 having different shapes are provided, only one abutting plate 222 may be provided.

Further, a connection hole 224 through which a conduction connector (not shown) is connected is formed in the main body 221. The plurality of connection holes 224 may be provided.

As shown in FIG. 2, the main body 221 is erected along the z-axis direction. In addition, the main body 221 is placed in the casing 10 such that the abutting plates 222 abut against the flange portion 212 of the holding material 21 and the holding material 21 and the substrate housing box 22 are opposed to each other. A circuit substrate is placed in a region formed in the holding material 21 and the substrate housing box 22 that are arranged in this manner, that is, a region in the holding portion 211 and the main body 221. A plurality of, for example, two circuit substrates are provided (drive substrate 61 and control substrate 62). As will be also described later, the drive substrate 61 is provided as a common single substrate on which an LED drive circuit 614 and the audio amplifier (AMP) 613 (see FIG. 9) to be described later are mounted.

The protrusion 223 is, as shown in FIG. 2, placed within the base 15 to be inserted into an opening end portion 12*b* on the rear side of the base casing 12. The protrusion 223 is formed in a tubular shape. A lead wire (not shown) that connects a terminal of a head top portion of the base 15 with a power-supply substrate 50 to be described later is placed to pass through the protrusion 223.

The substrate housing box 22 is made of a non-conductive material, for example, mainly an ABS resin material as in the above-mentioned holding material 21. In this manner, a material favorable as an electrically insulating material and a fire-retardant material are used for the holding material 21 and the substrate housing box 22.

A plurality of openings 214 are formed in the holding portion 211 of the holding material 21. With this, in the casing 10, a region outside the holding portion 211 of the holding material 21 and a region inside the holding portion 211 and the substrate housing box 22 communicate with each other via the openings 214. With such a configuration, in the casing 10, only the region outside the holding portion 211 but also the region inside the holding portion 211 and the substrate housing box 22 can be used as an enclosure of the speaker 30. With this, the capacity of the enclosure increases and the sound quality of the speaker 30 is improved. Note that only one opening 214 may be formed in the holding portion 211.

The base casing 12 is made of a material having a relatively high thermal conductivity, for example, mainly aluminum. As the material of the base casing 12, as long as it is a material having a relatively high thermal conductivity, another metal material such as copper may be used. Alternatively, the material of the base casing 12 may be a resin having a high heat dissipation or ceramic. The heat sink 23 and the base casing 12 are thermally connected to each other. As shown in FIG. 2, for example, the abutting surface 12*a* provided in the base casing 12 and the tapered surface 231 of the heat sink 23 abut against each other directly or via a thermally conductive sheet or the like, to thereby establish thermal conduction between these members. With this, heat generated from the light source unit 40 is efficiently dissipated to the outside via the heat sink 23 and the base casing 12.

Note that the main material of the heat sink 23 and the base casing 12 may be different.

In the structure of the light source apparatus 100 having the speaker 30, it is conceivable that vibration of the speaker 30 is transmitted to the supporting unit 20 and the base casing 12 configured as separate members. In general, as a phenomenon that can occur in the members to which the vibration of the speaker is transmitted, the generation of the chattering noise due to backlash if a minute gap is formed between the members adjacent to each other or if they are not stably assembled is exemplified.

Therefore, in this embodiment, as also described above, the tapered surface 231 on the side of the base 15 is provided as a surface that abuts against the base casing 12 of the supporting unit 20 connected to the speaker 30 and the tapered surface 231 is supported from the side of the base 15, to thereby reduce the backlash. In addition, the abutting surface 12*a* of the base casing 12 also has the tapered shape that abuts against the tapered surface 231, and hence the supporting unit 20 can be disposed with a stable structure by fitting the tapered surface 231 along the abutting surface 12*a*. In this manner, the tapered surfaces abut against each other, and hence the gap between the supporting unit 20 and the base casing 12 can be reduced. Thus, even if the vibration of the speaker 30 is transmitted, the generation of noise can be suppressed. That is, the supporting unit 20 and the base casing 12 function as a mechanical earth that reduces the effect of the vibration of the speaker 30.

As an comparison example, in a structure of fitting as in a bulb-shaped lamp disclosed in Japanese Patent No. 4659130, a disk like mount member on which the light source is mounted is fitted into an inner peripheral surface of a cylindrical case, an outer peripheral surface of the mount member and the inner peripheral surface of the case abut against each other in a horizontal direction. With such a structure, it is difficult to bring the inner peripheral surface of the case into close contact with the outer peripheral surface of the mount member. If the vibration of the speaker is transmitted to this configuration, there is a fear that noise due to backlash between the members is caused. In particular, if the case has a thin cylindrical shape, when the vibration is transmitted thereto, the chattering noise is easily generated and the effect on the sound quality becomes large.

However, in the case of the light source apparatus 100, due to the tilt of the tapered surface 231, the heat sink 23 is disposed on the abutting surface 12*a* of the base casing 12 while pushing the abutting surface 12*a* of the base casing 12 positioned around it in a vertical direction (direction of base 15). Therefore, the heat sink 23 including the tapered surface 231 can stabilize the position relationship between the supporting unit 20 and the base casing 12 not only in a horizontal direction but also in the vertical direction. Further, by the tapered surfaces abutting against each other, the heat sink 23 can be disposed to be pushed on the base casing 12 and held in close contact with it. Thus, even if the base casing 12 is formed with a thin wall, the tapered surface 231 can reliably prevent the backlash and reduce the generation of noise when the vibration is transmitted thereto.

Further, in manufacturing the light source apparatus 100, the heat sink 23 can be fitted into the base casing 12 along the tapered surface 231, and hence, for example, it is unnecessary to align the position of an outer peripheral surface of the heat sink 23 with the position of an inner peripheral surface of the base casing 12 with high accuracy and assembling becomes easy. For example, the heat sink 23 can be provided by sliding down the tapered surface 231 of the heat sink 23 along the bowl-like, tapered surface of the base casing 12, and hence it is possible to bring the heat sink 23 into close contact with the base casing 12 without strict dimensional accuracy and ensure heat transfer. In particular, if the tapered surface 231 has a taper angle of, for example, 30 degrees or more and 60 degrees or less, the tapered surface 231 is supported on the abutting surface 12*a* of the base casing 12 in the horizontal direction and the vertical direction, and hence it is possible to easily and reliably position them and bring them into close contact with each other and to reduce the backlash.

Referring to FIG. 2, the translucent cover 11 is disposed on the base casing 12 such that the opening end portion in which the abutting surface 12*a* of the base casing 12 is provided and the first opening portion 11*a* of the translucent cover 11 face each other. The supporting unit 20 supports the speaker 30 such that the translucent cover 11 is pushed on the heat sink 23 by the speaker 30, and sandwiches the translucent cover 11 between the speaker 30 and itself (supporting unit 20).

As described above, the speaker 30 supported by the supporting unit 20 serves to sandwich the translucent cover 11 with the heat sink 23 and push and support the translucent cover 11 on the heat sink 23. Therefore, it is unnecessary to directly fix the translucent cover 11 on the heat sink 23 and the speaker 30. Thus, even if the translucent cover 11 having a thermal expansion coefficient different from a thermal expansion coefficient of each of the heat sink 23 and (the frame 31 of) the speaker 30 is thermally expanded due to a change in temperature of the light source unit 40, deformation due to the thermal expansion of each of the opening portions 11*a* and 11*b* respectively facing the heat sink 23 and the speaker 30 can be tolerated and stress of the thermal expansion can be released. Thus, the generation of mechanical stress in the translucent cover 11, which deteriorates the translucent cover 11, can be suppressed.

(Configurations of Various Circuit Substrates)

As shown in FIG. 2, the power-supply substrate 50 on which the power-supply circuit 55 is mounted is placed in the base casing 12. The power-supply substrate 50 is fixed to the holding material 21 with a screw S2. Further, the power-supply substrate 50 is also fixed to the heat sink 23 with the above-mentioned screw S1 that connects the holding material 21 to the heat sink 23.

In general, from the perspective of adaptability of the LED bulb to an illumination device, it is desirable to downsize the LED bulb while making the LED bulb as close as possible to the incandescent light bulb shape. If the product size of the LED bulb is significantly increased, the product value is reduced. If the power-supply substrate and the LED drive circuit substrate are arranged in the same plane or arranged along parallel planes, the product size is increased and the outer periphery of the casing near the base is also increased in size. From the perspective of the adaptability of the illumination device, it is ideal to realize an LED bulb with the size of an outer periphery of a casing near the base being made close to that of the incandescent light bulb. Therefore, also from such a perspective, a product with the power-supply substrate and the other circuit substrate being arranged in the same plane as described above leads to a reduction in product value. In view of this, in the present technology, the circuit substrates are arranged in the following manner.

Figure 8:
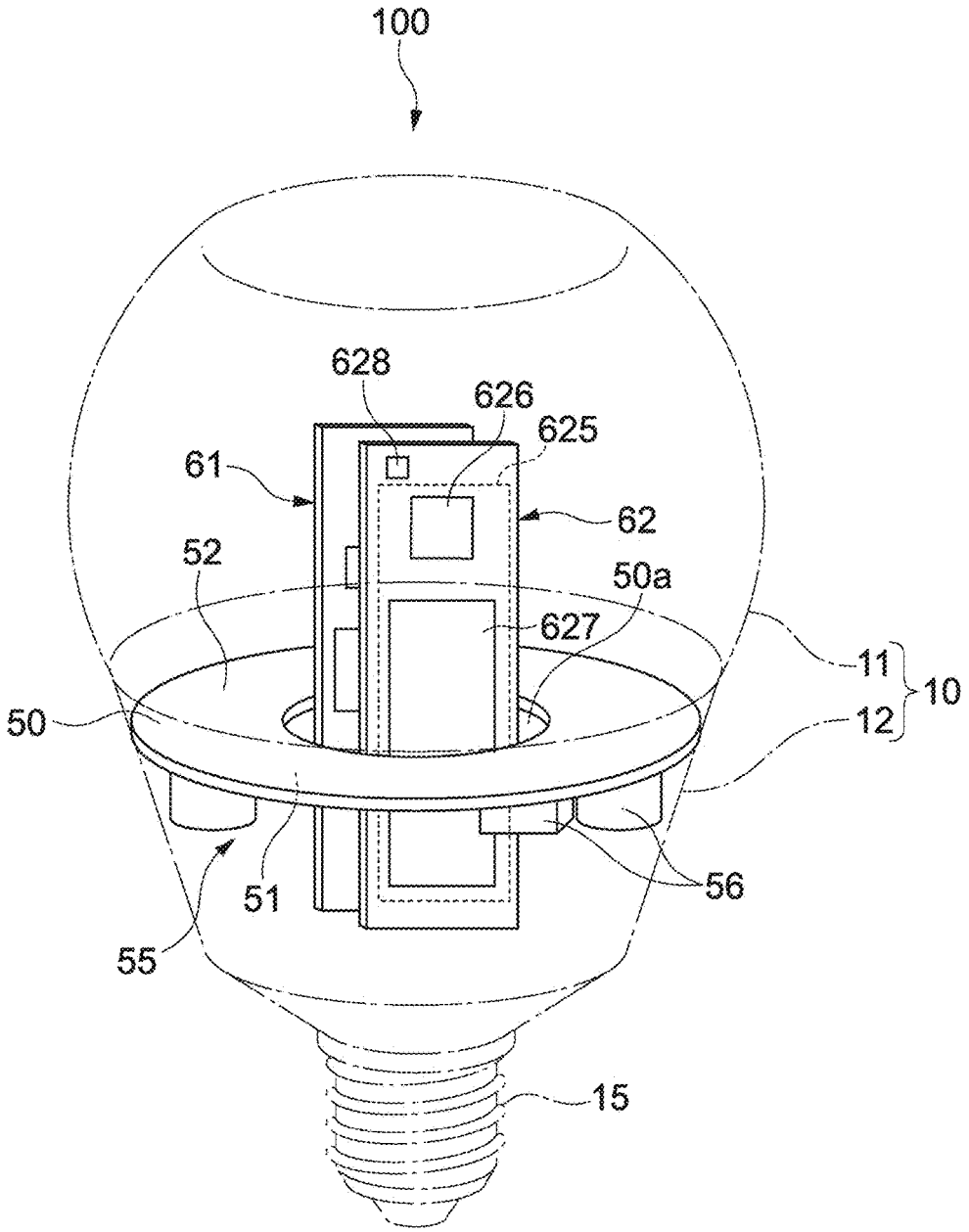
FIG. 8 A view showing a positional relationship between a power-supply substrate and another substrate (drive substrate and control substrate).

FIG. 8 is a view showing a position relationship between the power-supply substrate 50 and the other substrates (drive substrate 61 and control substrate 62 described above). The power-supply substrate 50 includes an opening region 50*a*. The drive substrate 61 and the control substrate 62 are partially placed in the opening region 50*a*.

Typically, the opening region 50*a* is made of a through-hole. In other words, the power-supply substrate 50 is formed in a ring shape. Specifically, as shown in FIG. 2, the main body 221 of the substrate housing box 22 is inserted into the opening region 50*a*. With this, the drive substrate 61 and the control substrate 62 that are placed in the substrate housing box 22 and the holding material 21 are arranged to perpendicularly cross the power-supply substrate 50 via the through-hole of the power-supply substrate 50.

In this manner, the drive substrate 61 and the control substrate 62 are arranged to be inserted into the through-hole of the power-supply substrate 50, and hence it is possible to efficiently arrange the parts in a small housing space of the casing 10 and to downsize the light source apparatus 100.

Specifically, an envelope shape of the entire substrates disposed as described above is similar to the shape obtained by disposing two schematic triangular shapes oppositely to each other along the z-axis direction. This shape is similar to an outline of the casing 10 in which the base casing 12 and the translucent cover 11 are fitted when the light source apparatus 100 is viewed from the side. That is, by disposing the substrates 50, 61, and 62 as described above, it is possible to increase the density of the parts in the casing 10, which can downsize the light source apparatus 100.

Further, it is possible to arrange the substrates 50, 61, and 62 in the casing 10 at a high density and to ensure a sufficient capacity as the enclosure of the speaker 30. Thus, it is possible to improve the sound quality of the speaker 30.

As shown in FIG. 8, a receiver (or light receiver) 628, an antenna 626, and a network control circuit 627 are mounted on the control substrate 62.

The receiver 628 receives an infrared signal transmitted by a remote controller (not shown) that can be used by a user. The position and attitude of the control substrate 62 are set such that the receiver 628 is positioned at a position in the casing 10, at which it can receive the infrared signal, that is, in a region in the translucent cover 11 (region on front side with respect to light source unit 40). For example, the receiver 628 is mounted on the end portion on the front side of the control substrate 62. The remote controller (not shown) is, for example, a device that generates signals about turn on, turn off, light control, color control, and the like of the light source unit 40.

The antenna 626 is typically an antenna for short-distance wireless communication such as Bluetooth. Further, the network control circuit 627 is configured in accordance with the communication standard. The position and attitude of the drive substrate 61 are set such that the antenna 626 is positioned at a position in the casing 10, at which it can receive the wireless signal, that is, a region in the translucent cover 11 (region on front side with respect to light source unit 40). For example, audio video (AV) device that is a target device operated by the user transmits a wireless signal and the antenna 626 receives the wireless signal. A signal transmitted by the AV device is, for example, a signal about volume, reproduction, stop, and the like of sound from the speaker 30. The AV device may be a portable device.

Note that the antenna 626 and the network control circuit 627 may be compliant with a communication standard for configuring wireless fidelity (WiFi), ZigBee, a wireless local area network (LAN), or the like in addition to the Bluetooth.

The power-supply substrate 50 includes a first face 51 opposed to the side of the base 15 and a second face 52 opposed to the side of the light source unit 40. Further, the power-supply circuit 55 on which the power-supply substrate 50 is mounted includes a transformer 56T (see FIG. 2) including a primary side coil and a secondary side coil and primary side electronic components 56 that are electrically connected to the primary side coil. The transformer 56T and the primary side electronic components 56 are mounted on the first face 51 of the power-supply substrate 50.

In this manner, the transformer 56T and primary side electronic components 56 having a relatively large size are arranged on the side of the base 15 of the power-supply substrate 50, and hence parts different from the power-supply circuit 55, for example, the light source unit 40 and the supporting unit 20 can be partially placed in the space on the front side with respect to the second face 52. With this, the narrow space in the casing 10 (or the base casing 12) can be efficiently used.

(Electrical Configuration of Light Source Apparatus)

Figure 9:
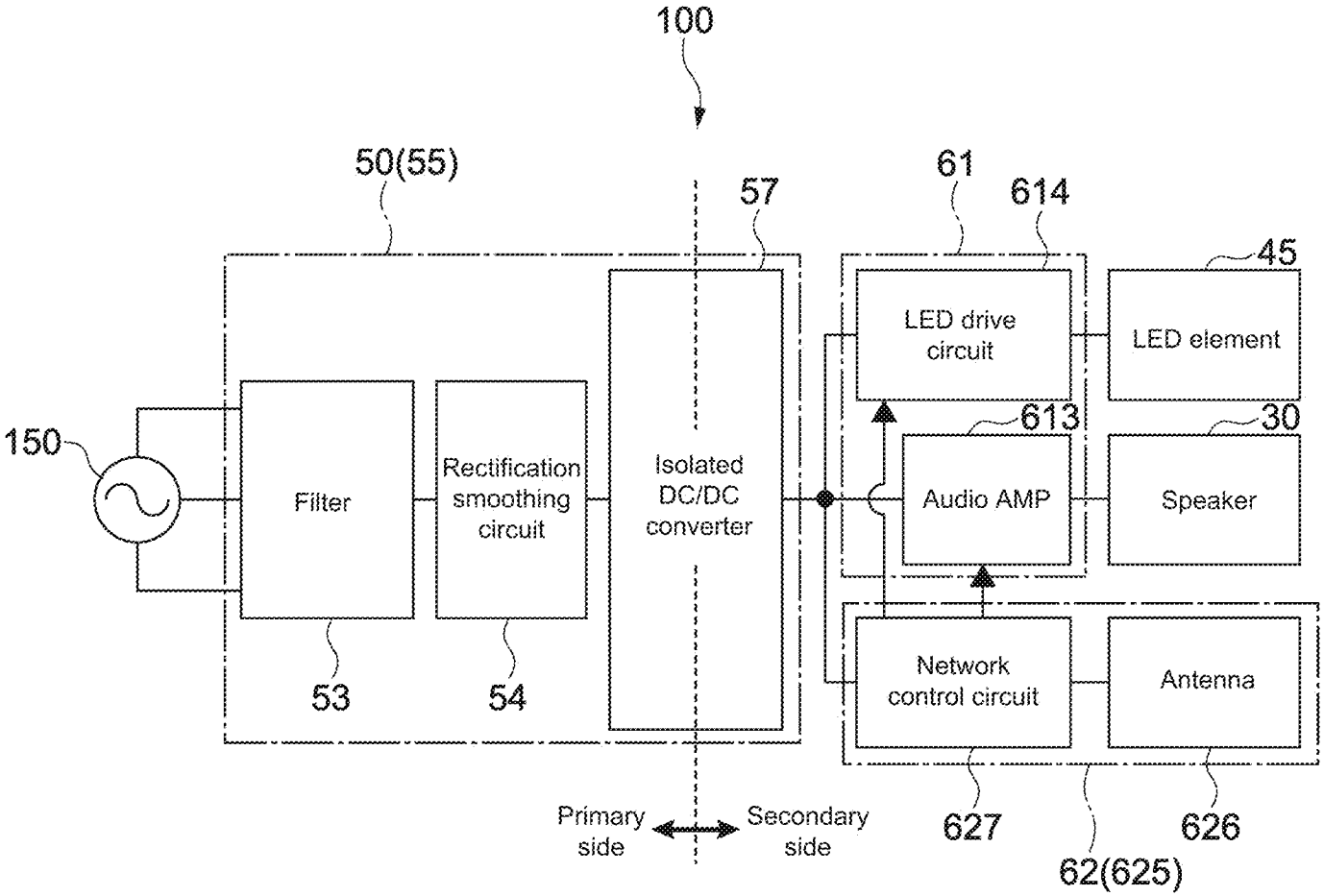
FIG. 9 A block diagram showing an electrical configuration of a light source apparatus.

FIG. 9 is a block diagram showing an electrical configuration of the light source apparatus 100.

The light source apparatus 100 includes a filter 53, a rectification smoothing circuit 54, an isolated DC/DC converter 57, the LED drive circuit 614, the audio AMP 613, and the network control circuit 627, and the antenna 626. A commercial power-supply 150 supplies a power to the power-supply circuit 55 via the base 15 of the light source apparatus 100.

The filter 53, the rectification smoothing circuit 54, and the isolated DC/DC converter 57 are the power-supply circuit 55 and mounted on the power-supply substrate 50 as described above. The isolated DC/DC converter 57 includes the above-mentioned transformer 56T. The isolated DC/DC converter 57 is used in the power-supply circuit 55, in which the primary side circuit and the secondary side circuit are electrically insulated from each other.

The LED drive circuit 614 and the audio AMP 613 are mounted on the drive substrate 61 as described above. The LED drive circuit 614 controls the turn-on, turn-off, light control, color control, and the like of the light source unit 40. The audio AMP 613 is a drive circuit for the speaker 30 and controls the volume, reproduction, stop, and the like of sound of the speaker 30.

As described above, the network control circuit 627 and the antenna 626 form a part of a control circuit 625 and mounted on the control substrate 62. The network control circuit 627 outputs, based on a single received via the receiver 628 and the antenna 626, content information of the received signal to the LED drive circuit 614 and the audio AMP 613.

(Configuration of Ground Connection of Electrical Circuit)

As shown in FIG. 2, a ground connection pattern 59 on the secondary side is formed on the first face 51 of the power-supply substrate 50. The ground connection pattern 59 is conducted to the heat sink 23 and the base casing 12 via the screw S1. In other words, the heat sink 23 and the base casing 12 serve as an electrical ground of the power-supply circuit 55.

In this manner, in this embodiment, an insulated type power-supply circuit is used and the secondary side circuit is connected to the ground. Thus, it is possible to obtain a suitable electro magnetic susceptibility (EMS) without generating electro magnetic interference (EMI) and the like and to satisfy the condition of the electro magnetic compatibility (EMC). That is, in the present technology, it is possible to reduce leak of high frequency noise from the drive substrate 61 and the like and to also reduce leak of radiation noise from the speaker 30. Further, of course, it is possible to also prevent exogenous noise from entering the casing 12.

By carrying out such an EMC measure on the light source apparatus 100, this light source apparatus 100 can be applied also to a so-called smart house.

Second Embodiment

Figure 10:
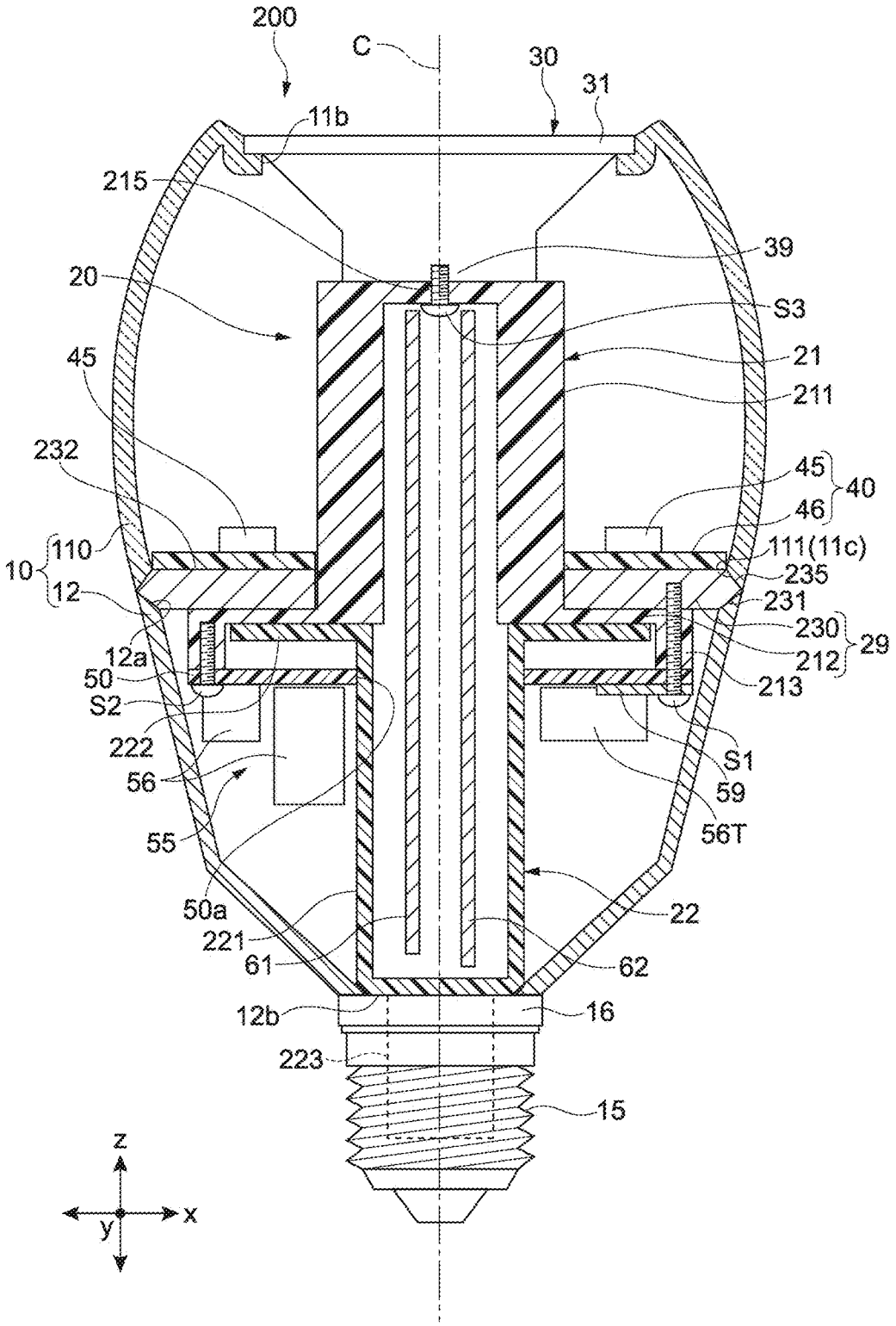
FIG. 10 A schematic cross-sectional view showing an electric light bulb type light source apparatus according to another embodiment of the present technology.

FIG. 10 is a schematic cross-sectional view of a light source apparatus 200 according to another embodiment of the present technology. Hereinafter, descriptions of the same members, functions, and the like as those of the light source apparatus 100 according to the embodiment shown in FIG. 1 and the like will be simplified or omitted and different points will be mainly described. The light source apparatus 200 includes a translucent cover 110 of the casing 10, which serves as the casing on the side of the speaker 30. The light source apparatus 200 includes a heat sink 230 that mainly forms the base portion 29 of the supporting unit 20.

As shown in FIG. 10, the heat sink 230 of the light source apparatus 200 includes the tapered surface 231 (first tapered surface) as the tapered surface that abuts against the abutting surface 12*a* of the base casing 12. The heat sink 230 further includes a tapered surface 233 (second tapered surface), which is formed to be spaced apart from the center of the base portion 29 as the distance from the supporting surface 232 increases. The tapered surface 233 is typically provided around the supporting surface 232 on a side of the heat sink 230, which faces the speaker 30, and has a shape tilted such that an outer periphery thereof is reduced in diameter as approaching the speaker 30. The tapered surface 233 has a taper angle of, for example, 30 degrees or more and 60 degrees or less. This tapered surface 233 enables the supporting unit 20 to stably support the translucent cover 110.

On the other hand, the translucent cover 110 includes a first opening portion 11*c* including a tapered abutting surface 111 that abuts against the tapered surface 233 of the heat sink 230. The translucent cover 110 can be disposed on the base portion 29 such that the abutting surface 111 of the first opening portion 11*c* faces the tapered surface 233 of the supporting unit 20. Further, the tapered surfaces abut against each other, and hence the gap between the base portion 29 and the translucent cover 110 can be reduced. Thus, even if the vibration is transmitted from the speaker 30, the generation of noise can be suppressed.

In addition, the translucent cover 110 of the light source apparatus 200 includes the second opening portion 11*b* provided to be closed by the speaker 30. The translucent cover 110 of the light source apparatus 200 is pushed by the speaker 30 supported by the supporting unit 20 from a side of the second opening portion 11*b* to a side of the base portion 29. The position of the translucent cover 110 on the tapered surface 233 of the base portion 29 becomes stable, and hence it becomes easy to assemble the structure that sandwiches and supports the translucent cover 110 between the base portion 29 and the speaker 30 and the backlash is also reduced.

As described above, in the case of the light source apparatus 100, the abutting surface against which the tapered surface abuts is formed in the base casing 12 of the casing 10. However, as in the above-mentioned light source apparatus 200 according to this embodiment, the abutting surface may be formed in the translucent cover 110 of the casing 10. According to this embodiment, with either the structure in which the tapered surface 231 of the base portion 29 abuts against the abutting surface 12*a* of the casing 10 (base casing 12) or the structure in which the tapered surface 233 of the base portion 29 abuts against the abutting surface 111 of the casing 10 (translucent cover 110), it is possible to obtain an effect of reducing noise due to the vibration of the speaker 30.

Third Embodiment

Figure 11:
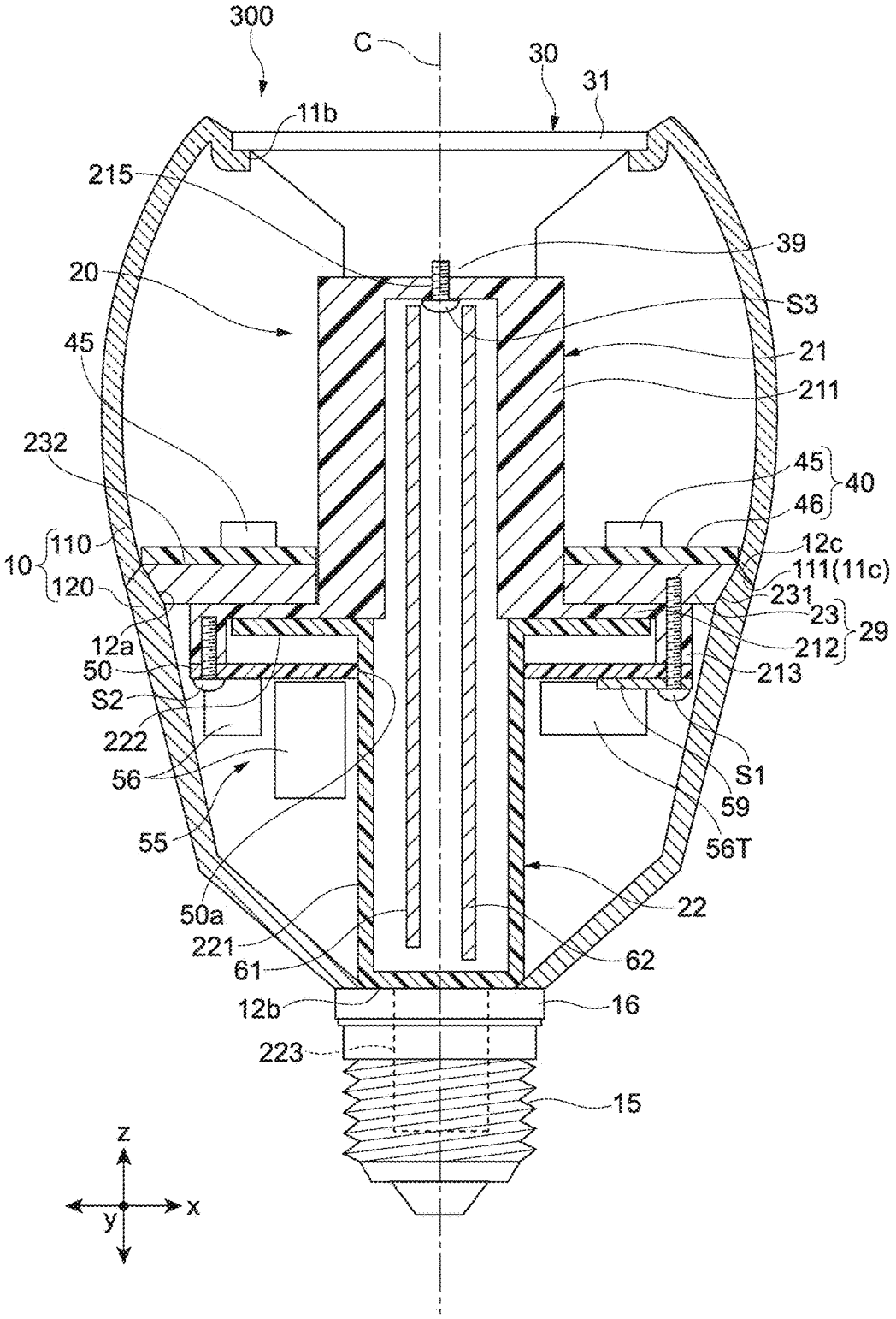
FIG. 11 A schematic cross-sectional view showing an electric light bulb type light source apparatus according to still another embodiment of the present technology.

FIG. 11 is a schematic cross-sectional view showing a light source apparatus 300 according to still another embodiment of the present technology. As shown in FIG. 11, the casing 10 of the light source apparatus 300 includes the translucent cover 110 similar to the light source apparatus 200 and a base casing 120 including a tapered surface 12*c* provided to be opposed to a first opening portion 1*c* of the translucent cover 110. The base casing 120 includes an opening end surface in which the base portion 29 is placed. The opening end surface of the base casing 120 includes the abutting surface 12*a* against which the heat sink 23 abuts, for example. The tapered surface 12*c* is a surface that is disposed around the opening end surface (abutting surface 12*a*) of the base casing 120 and formed to extend to the rear side as a distance from the opening end surface increases. For example, the tapered surface 12*c* has a shape tilted such that an outer periphery thereof is reduced in diameter as approaching the speaker 30 as in the tapered surface 233 of the heat sink 230 of the light source apparatus 200, which is provided on the side of the translucent cover 110.

Even if the tapered surface that abuts against and supports the translucent cover 110 is included not in the base portion 29 but in the base casing 120 in this manner, the same effects as described above can be obtained. In this embodiment, even if the vibration of the speaker 30 is transmitted to the casing 10 formed combining the base casing 120 with the translucent cover 110, it is possible to reduce the backlash, which results in noise.

Modified Example

Figure 12:
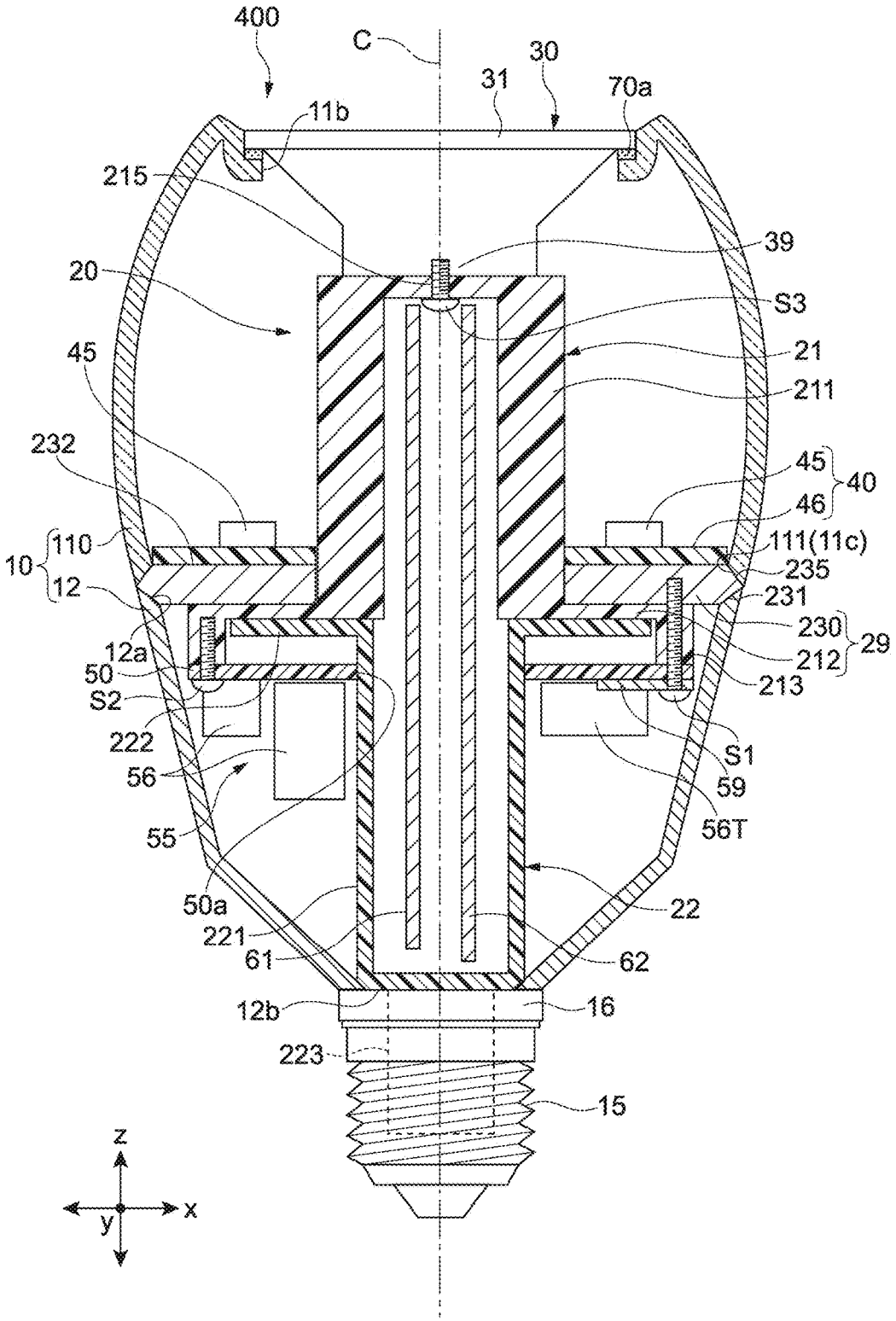
FIG. 12 A schematic cross-sectional view showing a modified example of the electric light bulb type light source apparatus.

FIG. 12 is a schematic cross-sectional view showing a light source apparatus 400 as a modified example to which the configuration of the light source apparatus 200 is applied. As shown in FIG. 12, the light source apparatus 400 further includes, in addition to the same configuration as the light source apparatus 200, a packing 70*a* provided between the speaker 30 and the translucent cover 110. Typically, a rubber such as an O-ring, an adhesive tape, or the like is used as the packing 70*a*.

When the packing 70*a* is interposed in the structure of closing the second opening portion 11*b* on the side of the speaker 30 in this manner, the gap between the speaker 30 and the translucent cover 110 can be reduced. The light source apparatus 400 can suppress the formation of the gap on a side of a first opening portion 11*a* of the translucent cover 110 by the use of the tapered surface 233 and the abutting surface 111 and suppress the formation of the gap on a side of the opening portion 11*b* by the use of the packing 70*a*. With this, it is possible to make the space surrounded with the translucent cover 110 more air-tight. Therefore, an effect of providing the space surrounded with the translucent cover 110 with a speaker box function, to thereby improve the sound quality of the speaker 30 can also be obtained.

Other Embodiments

The present technology is not limited to the above-mentioned embodiments and other various embodiments can be realized.

In each of the above-mentioned embodiments, the light source unit 40 on which the LED elements 45 having a point light emission function are mounted has been exemplified as the light source unit 40. The light source unit is not limited thereto, and for example, may be an organic or inorganic electro luminescence (EL) element, that is, a light source unit having a surface light emission function or may be a fluorescent lamp such as a cold cathode fluorescent lighting (CCFL) lamp having a three-dimensional light emission function.

Further, although the light source unit 40 has a ring shape, the light source unit 40 may have a polygonal shape having three or more sides or a linear shape (one or more linearly formed shapes). In a similar sense, the power source substrate 50 may also be formed in another shape.

In each of the above-mentioned embodiments, the metal material is used as the material of the heat sink and the base casing. However, as long as the material has a relatively high thermal conductivity, another material may be used. For example, the material of either one or both of the heat sink and the base casing may be a high dissipation resin or ceramic.

In the embodiment shown in FIG. 10, the heat sink 230 includes both of the tapered surface 231 (first tapered surface) on the side of the base casing 12 and a tapered surface 233 (second tapered surface) on a side of the translucent cover 110. However, the heat sink 230 may include only the tapered surface on the side of the translucent cover, which is formed as the second tapered surface, out of them may be provided. In this case, an effect of reducing the backlash at least between the tapered surface of the heat sink and the abutting surface of the translucent cover can be obtained.

Fourth Embodiment (Entire Configuration of Electric Light Bulb Type Light Source Apparatus)

Figure 13:
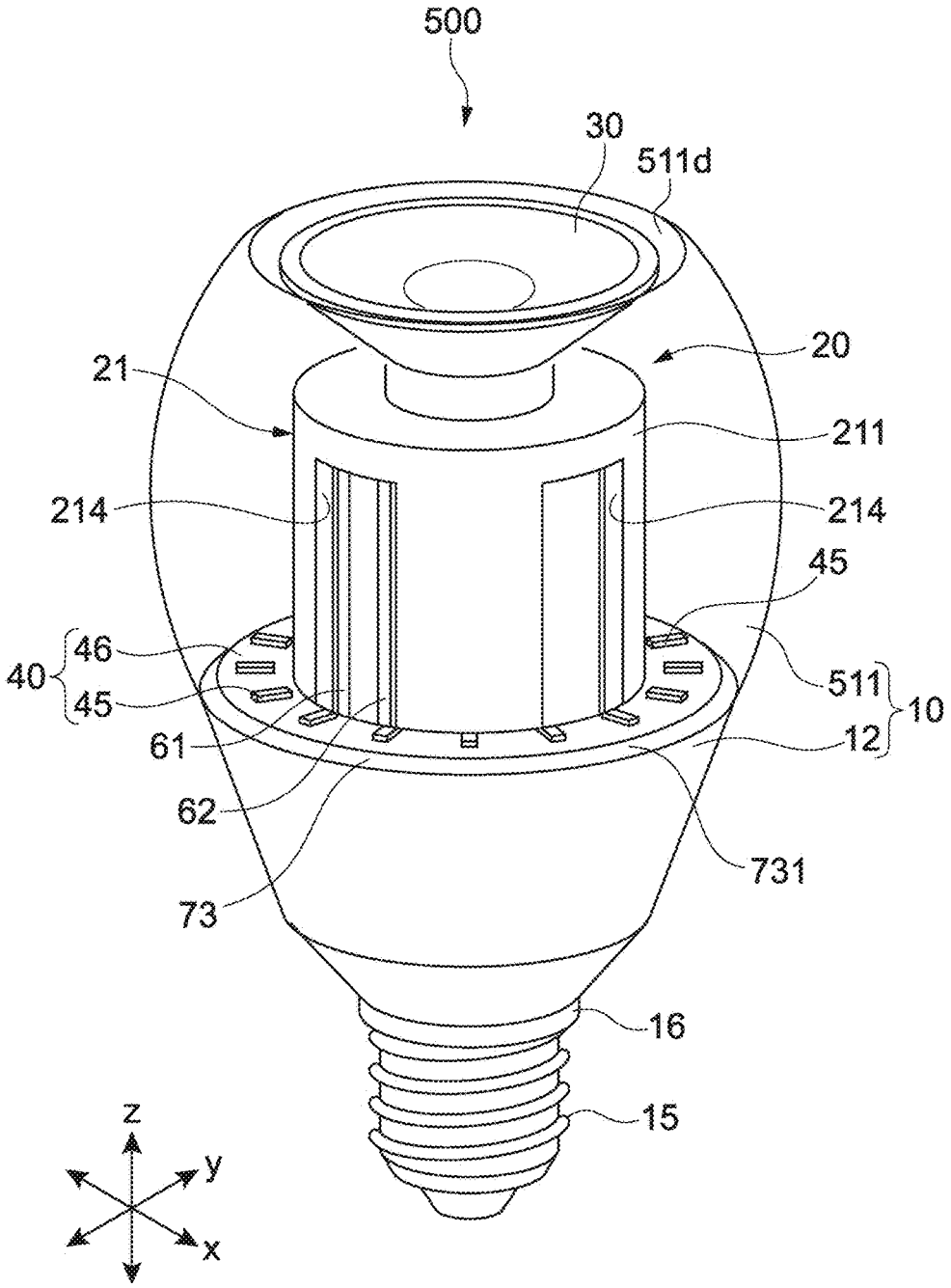
FIG. 13 A perspective view showing an electric light bulb type light source apparatus according to a fourth embodiment of the present technology.
Figure 14:
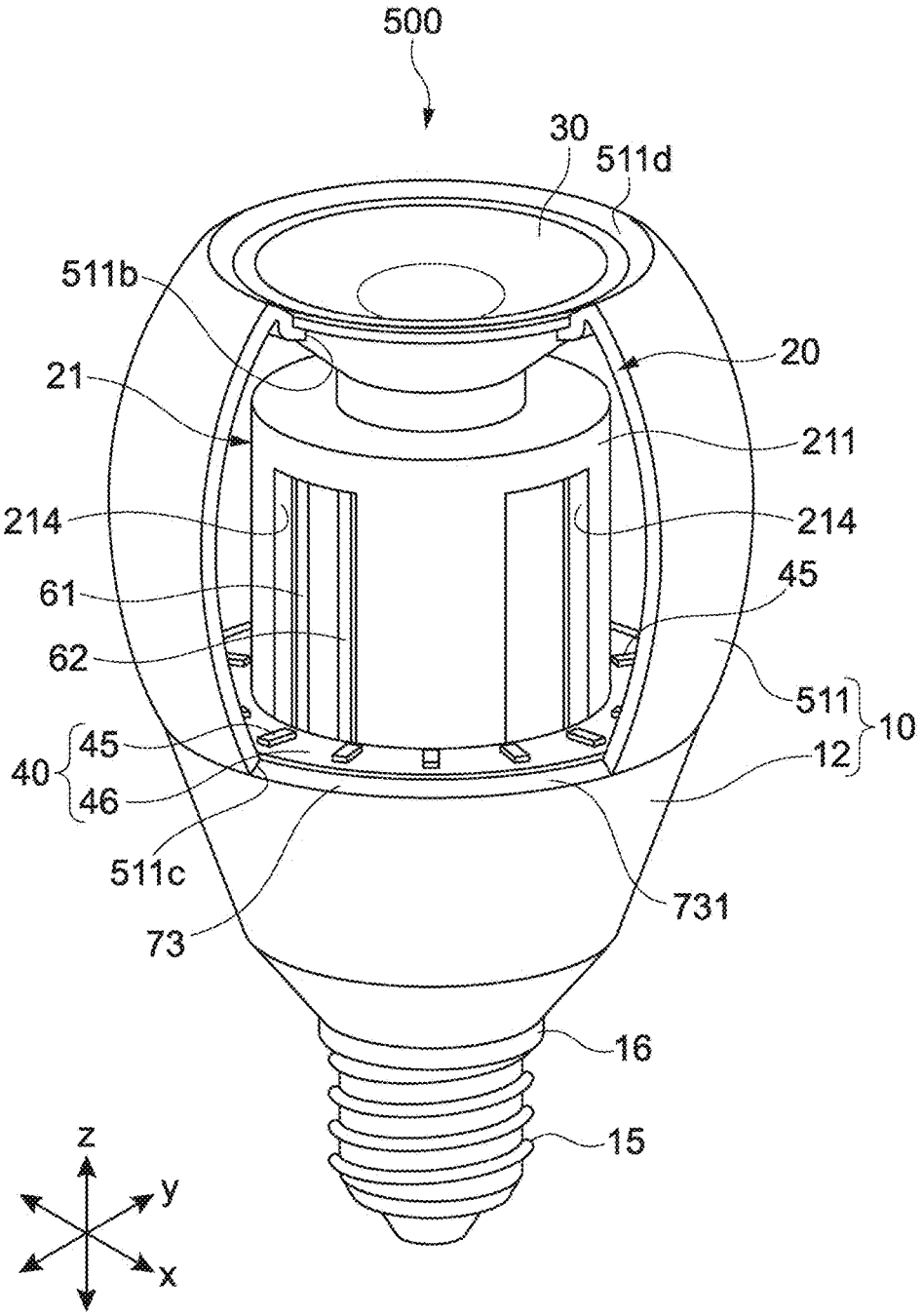
FIG. 14 A partially broken view of the electric light bulb type light source apparatus shown in FIG. 13.
Figure 15:
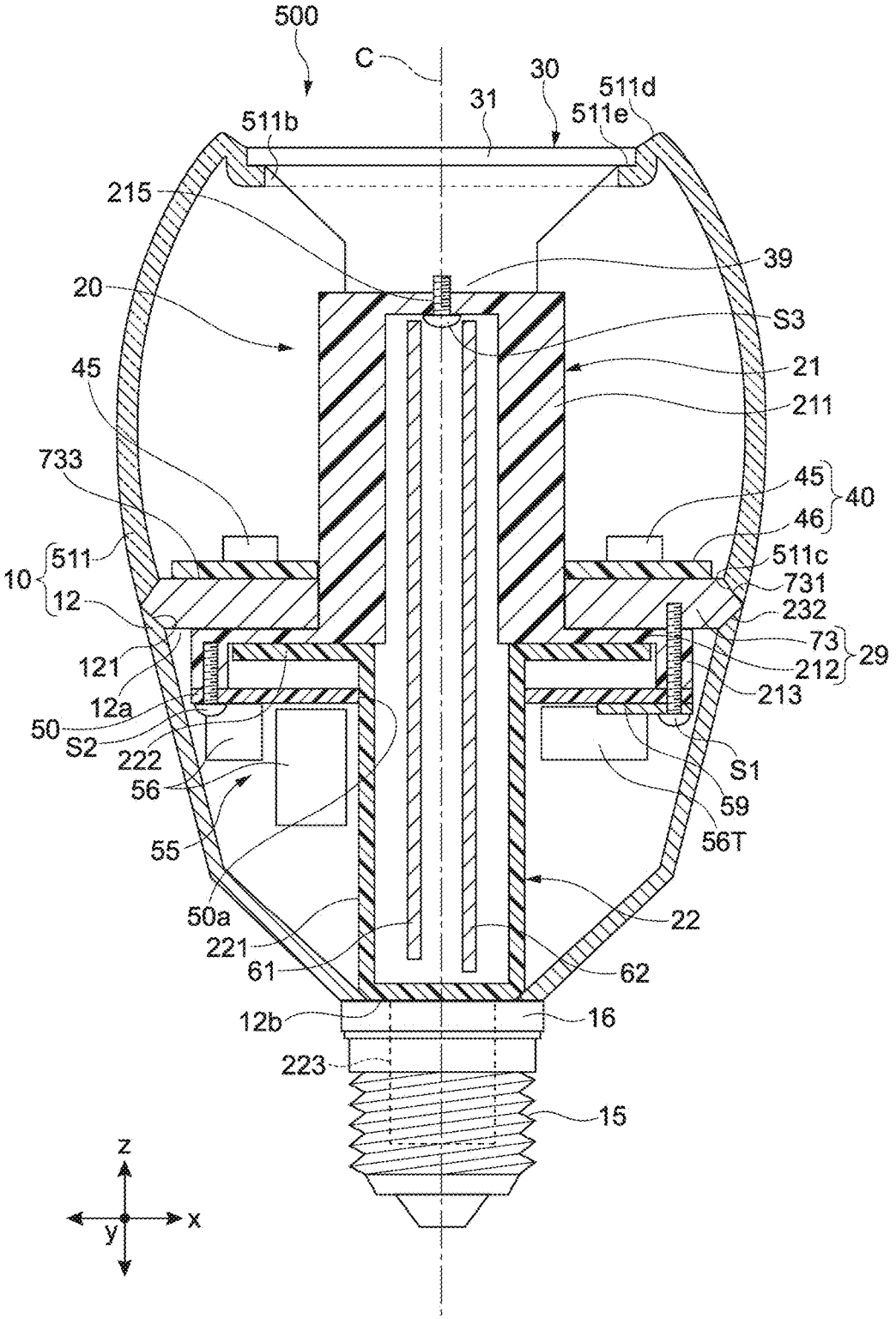
FIG. 15 A schematic cross-sectional view of the electric light bulb type light source apparatus shown in FIG. 13.

FIG. 13 is a perspective view showing an electric light bulb type light source apparatus according to an embodiment of the present technology. FIG. 14 is a partially broken view of the electric light bulb type light source apparatus 500 shown in FIG. 13. FIG. 15 is a schematic cross-sectional view of an electric light bulb type light source apparatus 500.

The light source apparatus 500 includes the supporting unit 20 that supports the speaker 30. The supporting unit 20 integrally supports the light source unit 40, the speaker 30, and the base 15 such that the light source unit 40 is provided between the speaker 30 and the base 15 with the speaker 30 and the light source unit 40 being spaced apart from each other. As shown in FIG. 15, typically, the supporting unit 20 includes a heat sink 73, the holding material 21 that is fixed to the heat sink 73 and holds the speaker 30, the substrate housing box 22 provided to be opposed to the holding material 21, and the base casing 12 that forms a part of the casing 10.

(Specific Configuration of Casing)

Figure 16:
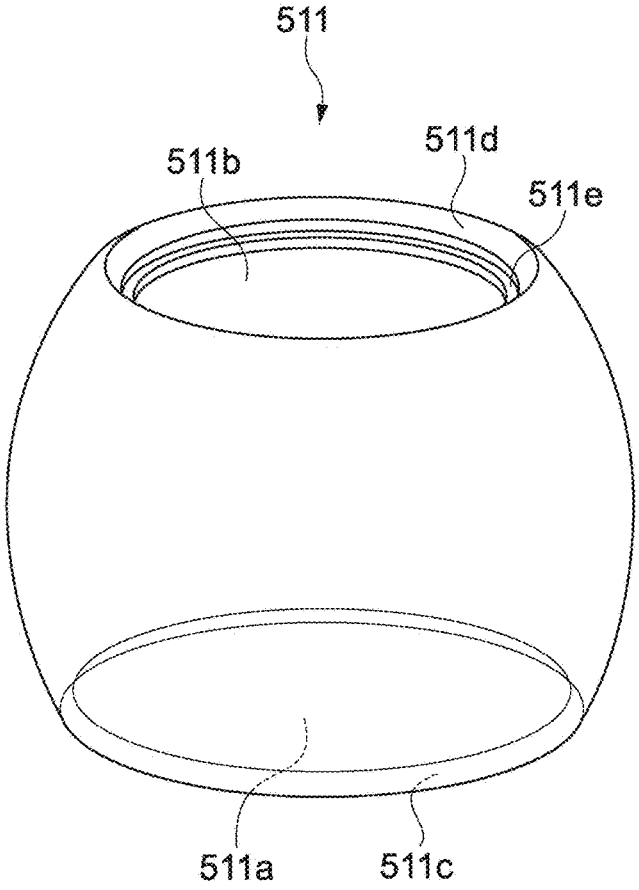
FIG. 16 A perspective view showing a translucent cover.

The casing 10 includes, for example, the base casing 12 and a translucent cover 511 provided on the front side of the base casing 12. FIG. 16 is a perspective view showing the translucent cover 511. A first opening 511*a* and a second opening 511*b* are formed in the translucent cover 511. The first opening 511*a* is provided in an end portion on the rear side and the second opening 511*b* is positioned on the opposite side along the z-axis direction.

As shown in FIGS. 15 and 16, the translucent cover 511 includes a first end surface 511*c* that forms the first opening 511*a* and a second end surface 511*d* that forms the second opening 511*b*. Further, the translucent cover 511 includes a speaker mounting surface 511*e* provided on the inner peripheral side of the second end surface 511*d*. Substantially, the speaker mounting surface 511*e* and the second end surface 511*d* form the second opening 511*b*. By the frame 31 of the speaker 30 being mounted on the speaker mounting surface 511*e*, the second opening 511*b* is closed. A ring-like packing (not shown) may be disposed on the speaker mounting surface 511*e* and the speaker 30 may be disposed on the packing. The ring-like heat sink 73 abuts against the first end surface 511*c* as will be described later. Further, the base casing 12 abuts against the heat sink 73 to close the first opening 511*a*. The translucent cover 511 is made of, for example, polycarbonate or acrylic.

The base casing 12 is made of a material having a relatively high thermal conductivity, for example, mainly aluminum. As the material of the base casing 12, another metal material such as copper may be used as long as it is a material having a high thermal conductivity. Alternatively, the material of the base casing 12 may be a high dissipation resin or ceramic. The heat sink 73 and the base casing 12 are thermally connected to each other. The shape of the base casing 12 is a bowl shape.

Figure 17:
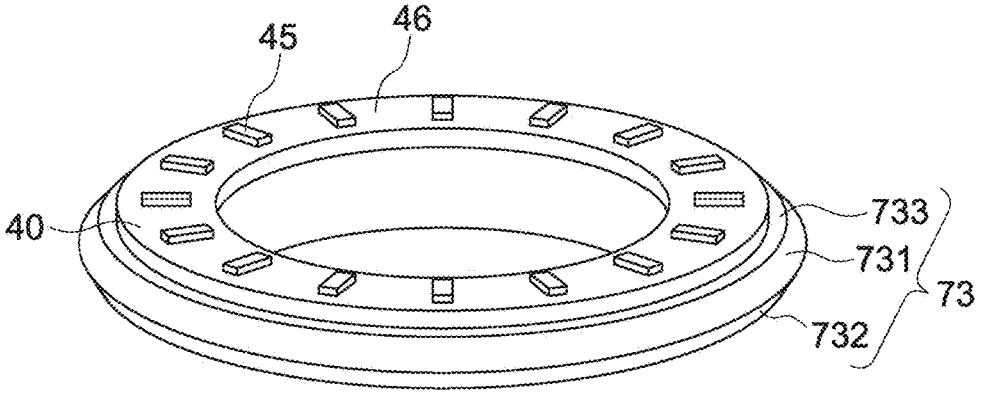
FIG. 17 A perspective view showing a heat sink of the supporting unit.

FIG. 17 is a perspective view showing the heat sink 73 of the supporting unit 20. The heat sink 73 includes a supporting surface 733 that supports the light source unit 40, a first tapered surface 731, and a second tapered surface 732. The supporting surface 733 faces the front side and the first tapered surface 731 and the second tapered surface 732 form a side surface of the heat sink 73.

As shown in FIGS. 14 and 15, a tapered surface 121 that forms an opening 12*a* of the base casing 12 is opposed to and abuts against the second tapered surface 732 of the heat sink 73. In this manner, the heat sink 73 and the base casing 12 are held in contact with each other directly or via a thermal conductive sheet (not shown) or the like, and hence thermal conduction between these members is established. With this, heat generated from the light source unit 40 is efficiently dissipated to the outside via the heat sink 73 and the base casing 12.

The heat sink 73 includes the second tapered surface 732 and the base casing 12 includes the tapered surface 121 that abuts against it. Therefore, the heat sink 73 is stably supported by the base casing 12 and rigidity of them is increased. Further, the tapered surfaces 121 and 732 are provided, and hence the heat sink 73 can be placed in the base casing 12 by lowering the heat sink 73, and hence it is possible to bring them into close contact with each other without strict dimensional accuracy. With this, it is possible to ensure heat transfer.

The first end surface 511*c* of the translucent cover 511 is opposed to and abuts against the first tapered surface 731 of the heat sink 73. In this case, the first tapered surface 731 functions as an opposed surface. The first end surface 511*c* functions as the abutting surface.

Figure 18:
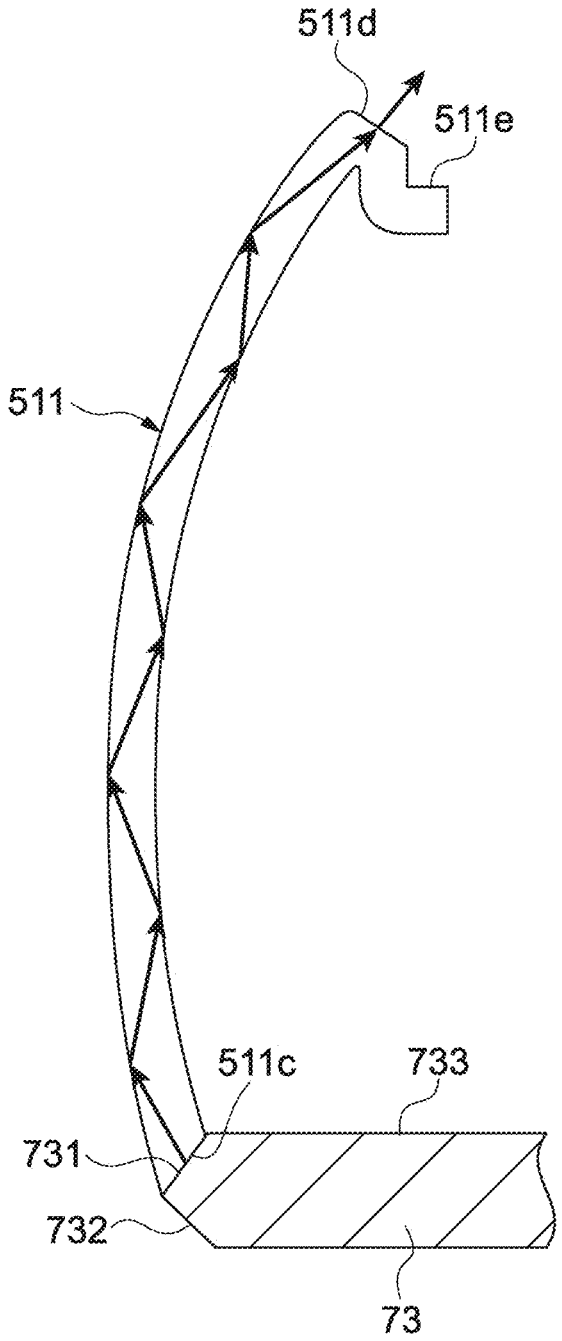
FIG. 18 A view showing a part of each of the heat sink and the translucent cover.

FIG. 18 is a view showing a part of each of the heat sink 73 and the translucent cover 511. The translucent cover 511 has a function of a light guide material and guides incident light from the first end surface 511*c* to the second end surface 511*d*. In this case, the first end surface 511*c* functions as the input end surface and the second end surface 511*d* functions as the output end surface. The shape and reflectance of the translucent cover 511 are set such that light inside the translucent cover 511 substantially repeats total reflection from the first end surface 511*c* to the second end surface 511*d*.

For example, the first end surface 511*c* or the first tapered surface 731 includes a colored region. Typically, an entire peripheral surface of the first end surface 511*c* or an entire peripheral surface of the first tapered surface 731 are colored. With this, the colored light (color light) is incident upon the first end surface 511*c* and emitted from the second end surface 511*d*, and hence the region around the frame 31 of the speaker 30 seems to be colored. With this, the outer appearance of the light source apparatus 500 is improved. The color of the colored region may be any color.

In general, the cross-section (end surface) of the glass seems to be in blue, blue green, green, or a color close thereto. For example, in the case where the first end surface 511*c* or the first tapered surface 731 is colored in blue, blue green, green, or a color close thereto in this manner, and hence even if the material of the translucent cover 511 is resin, the material, of the translucent cover 511 looks glass. Thus, it is possible to improve the texture of the translucent cover.

As the material of the translucent cover 511, as described above, a resin such as polycarbonate and acrylic is used. The reflectance of the polycarbonate is 1.58 and that of the acrylic is 1.49. If the translucent cover 511 has a shape of the glass portion of the electric light bulb as shown in FIGS. 13 and 14 and the like and includes, at a top end thereof, an end surface (second end surface 511*d*) that forms an opening (second opening 511*b*), the translucent cover 511 can function as a light guide member. Of course, it is unnecessary to guide entire light from the first end surface 511 to the second end surface 511*d* without omission and a part of the incident light only needs to reach the second end surface 511*d*.

Further, in this embodiment, the first end surface 511*c* has a taper shape and the heat sink 73 also includes the first tapered surface 731, and hence the fixing state of the translucent cover 511 and the heat sink 73 becomes stable and the entire rigidity of the translucent cover 511 and the heat sink 73 can be increased. Further, the first end surface 511*c* and the tapered surface 731 have a taper shape, and hence it is possible to reduce the gap between the translucent cover 511 and the heat sink 73 and it is possible to prevent noise (chattering noise), which is caused by the vibration of the speaker 30, from being generated.

In this embodiment, the holding material 21 that holds the speaker 30 is disposed to be surrounded with the light source unit 40. Thus, it is possible to reduce the arrangement space of the holding material 21 and the light source unit 40 in the electric light bulb type light source apparatus 500 and thus to increase the arrangement density of these members. Therefore, it is possible to downsize the light source apparatus 500 while ensuring a desired light distribution angle.

The supporting unit 20 supports the speaker 30 such that the translucent cover 511 is pushed on the heat sink 73 by the speaker 30. The translucent cover 511 is sandwiched between the speaker 30 and itself (supporting unit 20).

The heat sink 73 mainly forms the base portion 29 of the supporting unit 20. The base portion 29 of the supporting unit 20 also includes the flange portion 212 of the holding material 21.

Fifth Embodiment

Figure 19:
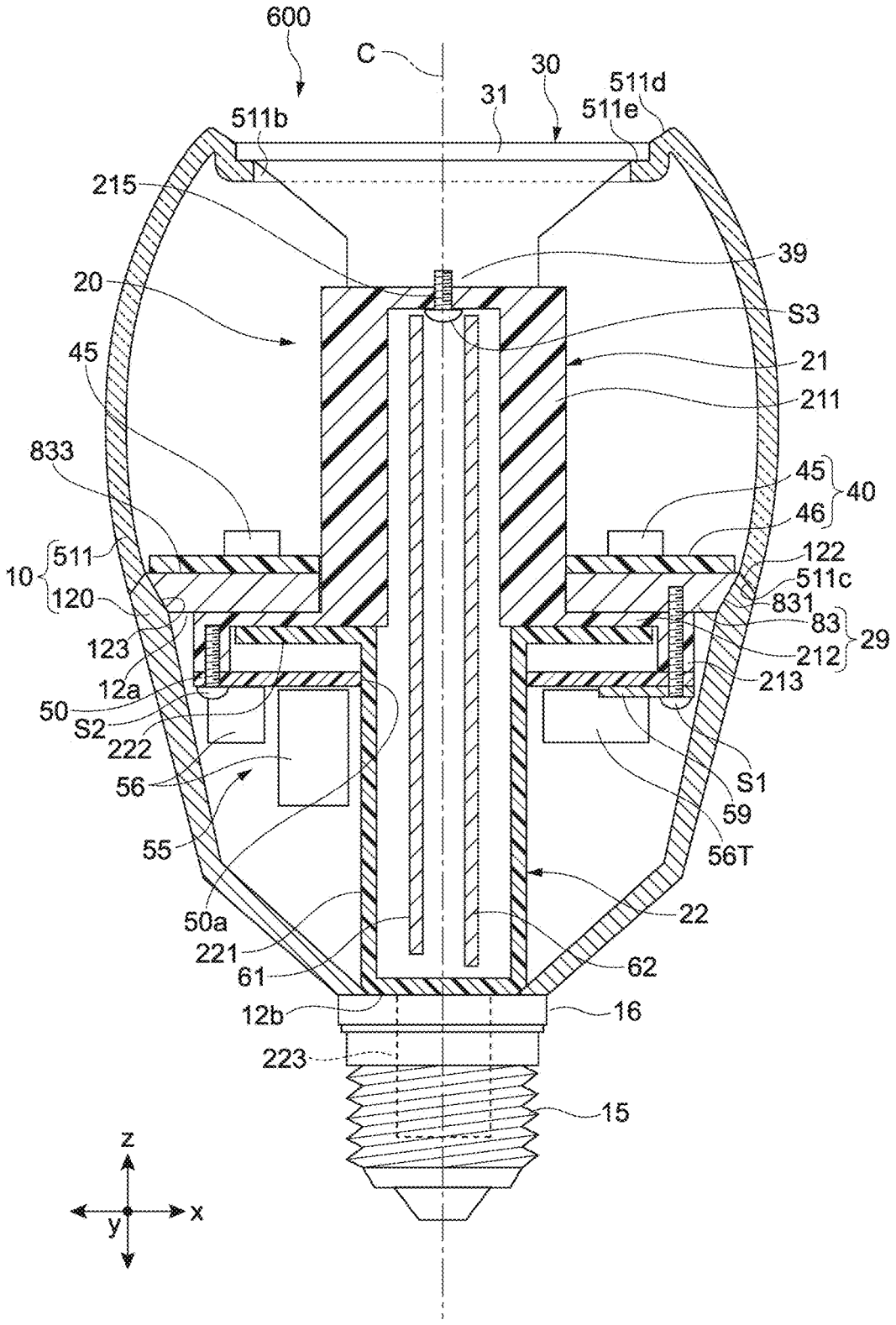
FIG. 19 A cross-sectional view showing an electric light bulb type light source apparatus according to a fifth embodiment of the present technology.

FIG. 19 is a cross-sectional view showing a light source apparatus according to a fifth embodiment of the present technology.

Hereinafter, descriptions of the same members, functions, and the like as those of the light source apparatus 500 according to the embodiment shown in FIG. 13 and the like will be simplified or omitted and different points will be mainly described.

A heat sink 83 of a light source apparatus 600 includes a supporting surface 833 that supports the light source unit 40 and a tapered surface 831 that abuts against the base casing 120. The heat sink 83 is formed in a ring shape around the holding portion 211 as in each of the above-mentioned embodiments. The tapered surface 831 abuts against an inner tapered surface (tapered abutting surface) 123 that forms the opening 12*a* of the base casing 120. With this, as in the above-mentioned first embodiment, it is possible to increase the rigidity of the heat sink 83 and the base casing 120.

Further, the base casing 120 includes an outer tapered surface 122 formed in an outer periphery of the inner tapered surface 123. The first end surface 511*c* serving as the input end surface of the translucent cover 511 is opposed to the outer tapered surface 122 of the base casing 120. In this case, the outer tapered surface 122 functions as the opposed surface. That is, the first end surface 511*c* of the translucent cover 511 or the outer tapered surface 122 of the base casing 120 are colored, and hence the translucent cover 511 can guide the colored light to the second end surface 511*d* and emit it from the second end surface 511*d*. The region around the frame 31 of the speaker 30 seems to be colored. With this, the outer appearance of the light source apparatus 600 can be improved.

Further, in this embodiment, the first end surface 511*c* has a taper shape and the base casing 120 also includes the outer tapered surface 122, and hence the fixing state of the translucent cover 511 and the base casing 120 becomes stable and the entire rigidity of the translucent cover 511 and the base casing 120 can be increased. Further, the first end surface 511*c* and the outer tapered surface 122 have a taper shape, and hence it is possible to reduce the gap between the translucent cover 511 and the base casing 120 and it is possible to prevent noise (chattering noise), which is caused by the vibration of the speaker 30, from being generated.

Other Embodiments

The present technology is not limited to the above-mentioned embodiment and other various embodiments can be realized.

Although the light source unit 40 has a ring shape, the light source unit 40 may have a polygonal shape having three or more sides or a linear shape (one or more linearly formed shapes). In a similar sense, the power source substrate 50 and the heat sink 73 (83) may also be formed in another shape.

As the material of the translucent cover, polycarbonate or acrylic may be replaced by glass. The reflectance of the glass is 1.4 to 1.5.

For example, in FIG. 15, a packing (not shown) may be disposed between the first end surface 511*c* of the translucent cover 511 and the first tapered surface 731 of the heat sink 73. In a similar sense, the packing may be provided also in the light source apparatus 600 (FIG. 19) according to the second embodiment.

In each of the above-mentioned embodiments, the first end surface 511*c* of the translucent cover 511 has a taper shape. However, the first end surface 511*c* does not need to have a taper shape and may have a plane along an x-direction. In this case, the opposed surfaces of the heat sink 73 and the base casing 120, which are opposed to the first end surface 511*c*, are surfaces along the x-direction.

Although the light source apparatus according to each of the above-mentioned embodiments includes the speaker, the light source apparatus may include another device instead of the speaker. The other device is, for example, an image sensor, an optical sensor, an ultrasonic wave sensor, a radiation sensor, or a temperature sensor.

The above-mentioned supporting unit 20 includes the heat sinks 73 and 83 as a part of the supporting unit 20. However, instead of the heat sinks 73 and 83, another member without the high thermal conductivity function may be provided.

At least two features out of the features of each of the above-mentioned embodiments can be combined.

Note that the present technology may also employ the following configurations.

(1) An electric light bulb type light source apparatus, including:

a speaker;

a light source unit;

a supporting unit that includes a base portion including a tapered surface and a supporting surface that supports the light source unit, and supports the speaker;

a casing including an abutting surface against which the tapered surface of the base portion abuts; and a base that is used for supplying a power to the light source unit and the speaker.

(2) The electric light bulb type light source apparatus according to (1), in which the supporting unit, the speaker, and the base are arranged such that the base portion is disposed between the speaker and the base, the supporting unit further includes a holding portion that holds the speaker such that the supporting surface of the base portion faces the speaker, and the base portion of the supporting unit is disposed around the holding portion.

(3) The electric light bulb type light source apparatus according to (2), in which the tapered surface of the base portion is a surface formed to approach a center of the base portion, at which the holding portion is located, as a distance from the supporting surface increases.

(4) The electric light bulb type light source apparatus according to (3), in which the casing includes a base casing including a tapered surface that abuts against the tapered surface of the base portion as the abutting surface.

(5) The electric light bulb type light source apparatus according to (3) or (4), in which the supporting unit includes a heat sink that forms at least a part of the base portion, and the casing includes a base casing including the abutting surface, which is thermally connected to the heat sink.

(6) The electric light bulb type light source apparatus according to (2), in which the tapered surface of the base portion is a surface formed to be spaced apart from a center of the base portion, at which the holding portion is located, as a distance from the supporting surface increases.

(7) The electric light bulb type light source apparatus according to (6), in which the casing includes a translucent cover including a tapered surface that abuts against the tapered surface of the base portion as the abutting surface.

(8) The electric light bulb type light source apparatus according to (7), in which the translucent cover includes a first opening portion including the tapered surface serving as the abutting surface, and a second opening portion provided to be closed by the speaker.

(9) The electric light bulb type light source apparatus according to (8), further including a packing provided between the speaker and the translucent cover.

(10) The electric light bulb type light source apparatus according to any one of (1) to (9), in which the tapered surface of the supporting unit has a taper angle of 30 degrees or more and 60 degrees or less.

(11) The electric light bulb type light source apparatus according to any one of (1) to (10), in which the light source unit includes a light emitting diode (LED) or an electro luminescence (EL) element as a light source element.

(12) An electric light bulb type light source apparatus, including:

a speaker;

a light source unit;

a supporting unit that supports the light source unit and the speaker;

a casing that includes a base casing including a tapered surface and a translucent cover including an abutting surface that abuts against the tapered surface, and houses the light source unit and the supporting unit; and a base that is used for supplying a power to the light source unit and the speaker.

(13) The electric light bulb type light source apparatus according to (12), in which the supporting unit includes a holding portion that holds the speaker, and a base portion that is disposed around the holding portion and supports the light source unit, and the supporting unit, the speaker, and the base are arranged such that the base portion is disposed between the speaker and the base.

(14) The electric light bulb type light source apparatus according to (13), in which the base casing includes an opening end surface in which the base portion is placed, and the tapered surface is disposed around the opening end surface and is a surface formed to approach the base along a direction, in which the speaker, the base portion, and the base are arranged, as a distance from the opening end surface increases.

(15) The electric light bulb type light source apparatus according to (13) or (14), in which the translucent cover includes a tapered surface that abuts against the tapered surface of the base casing as the abutting surface.

(16) An electric light bulb type light source apparatus, including:

a speaker;

a light source unit;

a translucent cover that includes a first opening, an input end surface of light that forms the first opening, a second opening, and an output end surface that forms the second opening and outputs light, and guides light from the input end surface to the output end surface;

a supporting unit that includes an opposed surface that is disposed to be opposed to the input end surface and a holding portion that holds the speaker such that the speaker is placed in the second opening, and supports the speaker and the light source unit; and a base that is used for supplying a power to the light source unit and the speaker.

(17) The electric light bulb type light source apparatus according to (16), in which the supporting unit includes a heat sink including the opposed surface and a supporting surface that supports the light source unit.

(18) The electric light bulb type light source apparatus according to (17), in which the opposed surface is a tapered surface formed in the heat sink.

(19) The electric light bulb type light source apparatus according to (17) or (18), in which the heat sink is formed in a ring shape around the holding portion.

(20) The electric light bulb type light source apparatus according to (16), in which the supporting unit includes a base casing including the opposed surface.

(21) The electric light bulb type light source apparatus according to (20), in which the opposed surface is a tapered surface formed in the base casing.

(22) The electric light bulb type light source apparatus according to (20) or (21), in which the supporting unit includes a heat sink formed in a ring shape around the holding portion and supporting the light source unit, and the base casing includes an opening in which the heat sink is placed.

(23) The electric light bulb type light source apparatus according to (22), in which the base casing includes a tapered abutting surface that forms an end surface of the opening together with the opposed surface, against which the heat sink abuts.

(24) The electric light bulb type light source apparatus according to any one of (16) to (23), in which the input end surface of the translucent cover or the opposed surface of the supporting unit includes a colored region that is colored to reflect color light.

(25) An electric light bulb type light source apparatus, including:

a sensor;

a light source unit;

a translucent cover including a first opening, an input end surface of light that forms the first opening, a second opening, and an output end surface that forms the second opening and emits light, and guides the light incident upon the input end surface to the output end surface;

a supporting unit that includes an opposed surface that is arranged to be opposed to the input end surface and a holding portion that holds the sensor such that the sensor is placed in the second opening, and supports the sensor and the light source unit; and a base that is used for supplying a power to the light source unit and the sensor.

(26) A translucent cover, including:

an input end surface that forms a first opening in which an opposed surface provided in a supporting unit that supports a speaker and a light source unit can be placed, upon which light is incident; and an output end surface that forms a second opening in which the speaker supported by the supporting unit can be placed, from which light is emitted, the translucent cover covering the light source unit supported by the supporting unit and guiding the light incident upon the input end surface to the output end surface.

(27) A translucent cover, including:

an input end surface that forms a first opening in which an opposed surface provided in the supporting unit that supports a sensor and a light source unit can be placed, upon which light is incident; and an output end surface that forms a second opening in which a sensor supported by the supporting unit can be placed, the output end surface having light emitted therefrom, the translucent cover covering the light source unit supported by the supporting unit and guiding the light incident upon the input end surface to the output end surface.

DESCRIPTION OF SYMBOLS

10 casing
11, 110 translucent cover
11*b* second opening portion
11*c* first opening portion
12, 120 base casing
12*a* abutting surface (abutting surface, opening end surface)
111 abutting surface
15 base
20 supporting unit
21 holding member
23, 73, 83, 230 heat sink
29 base portion
30 speaker
40 light source unit
45 LED element
70*a* packing
100, 200, 300, 400, 500, 600 electric light bulb type light source apparatus
121 tapered surface
122 outer tapered surface
123 inner tapered surface
211 holding portion
231, 233, 12*c* tapered surface
232 supporting surface
511*a* first opening
511*b* second opening
511*c* first end surface
511*d* second end surface
731 first tapered surface
732 second tapered surface
733 supporting surface
831 tapered surface
833 supporting surface

The invention claimed is:

1. An electric light bulb type light source apparatus, comprising:

a speaker;

a light source unit;

a supporting unit that includes a base portion including a tapered surface and a supporting surface that supports the light source unit, and supports the speaker;

a casing on which the supporting unit is disposed; and a base that is used for supplying a power to the light source unit and the speaker, the supporting unit includes a heat sink that forms at least a part of the base portion, the heat sink being formed in a ring shape, the tapered surface and the supporting surface being included on the heat sink, the tapered surface being provided at an outer periphery of the heat sink and having a tapered angle such that the outer periphery of the heat sink is reduced in diameter as a distance to the base decreases, and the casing including an abutting surface which is tapered in an angular manner corresponding to the tapered angle of the tapered surface such that the abutting surface abuts against the tapered surface of the heat sink when the supporting unit is disposed on the casing, wherein the supporting unit, the speaker, and the base are arranged such that the base portion is disposed between the speaker and the base, the supporting unit further includes a holding portion that holds the speaker such that the supporting surface of the base portion faces the speaker, and the base portion of the supporting unit is disposed around the holding portion, wherein the casing includes a translucent cover, and wherein the translucent cover includes a first opening portion, and a second opening portion provided to be closed by the speaker.

2. The electric light bulb type light source apparatus according to claim 1, further comprising a packing provided between the speaker and the translucent cover.

3. The electric light bulb type light source apparatus according to claim 1, wherein the tapered surface has a taper angle between 30 degrees and 60 degrees with respect to a plane parallel to the supporting surface.

4. The electric light bulb type light source apparatus according to claim 1, wherein the casing includes a base casing which includes the abutting surface.

5. The electric light bulb type light source apparatus according to claim 1, wherein the casing includes a base casing including the abutting surface, which is thermally connected to the heat sink.

* * * * *